US008449218B2

(12) United States Patent
McPhail et al.

(10) Patent No.: US 8,449,218 B2
(45) Date of Patent: May 28, 2013

(54) LAND FILL COMPACTOR WHEEL TIP ASSEMBLY

(75) Inventors: James D. McPhail, Peoria, IL (US); Michael Hans Hinrichsen, Congerville, IL (US); Randy E. Schoepke, Lacon, IL (US)

(73) Assignee: Caterpillar Inc., Peoria, IL (US)

( * ) Notice: Subject to any disclaimer, the term of this patent is extended or adjusted under 35 U.S.C. 154(b) by 390 days.

(21) Appl. No.: 12/827,727

(22) Filed: Jun. 30, 2010

(65) Prior Publication Data

US 2012/0003042 A1 Jan. 5, 2012

(51) Int. Cl.
*E01C 19/26* (2006.01)

(52) U.S. Cl.
USPC ..... 404/124; 404/121

(58) Field of Classification Search
USPC ..... 404/121, 122, 124, 128; 37/452, 37/454
See application file for complete search history.

(56) References Cited

U.S. PATENT DOCUMENTS

| | | | | |
|---|---|---|---|---|
| 3,252,391 | A | | 5/1966 | Dils, Jr. |
| 3,274,908 | A | | 9/1966 | Grant et al. |
| 3,598,028 | A | | 8/1971 | Grant et al. |
| 3,656,418 | A | | 4/1972 | Lutz |
| 3,891,341 | A | | 6/1975 | Trainor et al. |
| 4,066,375 | A | | 1/1978 | Caron et al. |
| 4,074,942 | A | | 2/1978 | Cochran |
| 4,530,620 | A | | 7/1985 | McCartney |
| 4,668,122 | A | | 5/1987 | Riddle |
| 4,750,792 | A | | 6/1988 | Caron et al. |
| 4,865,400 | A | | 9/1989 | Caron et al. |
| 4,919,566 | A | | 4/1990 | Caron et al. |
| 5,217,321 | A | * | 6/1993 | Corcoran et al. ..... 404/121 |
| 5,217,322 | A | | 6/1993 | Corcoran et al. |
| D338,677 | S | * | 8/1993 | Corcoran et al. ..... D15/28 |
| D338,898 | S | * | 8/1993 | Corcoran et al. ..... D15/28 |
| 5,358,355 | A | | 10/1994 | Brockway |

(Continued)

FOREIGN PATENT DOCUMENTS

| | | |
|---|---|---|
| GB | 2 214 878 A | 9/1989 |
| GB | 2290506 | 1/1996 |

OTHER PUBLICATIONS

Caron Compactor Company, Inc. website pages, http://caroncompactor.com/products/new-compactors (28 pages), Feb. 2, 2011.

HJ Industries website pages, http://hjindustries.com/ (2 pages), http://hjindustries.com/TracPacCombactorWheels.html (2 pages), http://hjindustries.com/LandfillCleats.html (2 pages), Feb. 2, 2011.

(Continued)

*Primary Examiner* — Matthew D Troutman
(74) *Attorney, Agent, or Firm* — Miller, Matthias & Hull

(57) ABSTRACT

A compactor wheel tip assembly for a landfill or soil compactor comprises a base with a tip attached thereto. A base engaging surface of the tip and a tip engaging surface of the base face and abut when the tip is attached to the base. The tip and base engaging surfaces may have corresponding geometries so that the tip may be attached the base in either a forward and rearward traction position or a side-slop traction position. The tip may include pocket walls having concave surfaces, and a ground engaging surface of a top wall that may be generally planar with a "bow-tie"-shaped cross-section or may define a pair of shoulders, a rib extending between the shoulders, and exterior pockets disposed on either side of the rib.

21 Claims, 17 Drawing Sheets

U.S. PATENT DOCUMENTS

| | | | | |
|---|---|---|---|---|
| 5,769,507 | A | 6/1998 | Brockway | |
| 5,795,097 | A | 8/1998 | Caron et al. | |
| 5,967,242 | A | 10/1999 | Caron et al. | |
| 6,095,717 | A | 8/2000 | Kaldenberg et al. | |
| D453,940 | S | 2/2002 | McCartney | |
| 6,619,883 | B2 | 9/2003 | Livesay et al. | |
| 6,632,045 | B1 | 10/2003 | McCartney | |
| 6,682,262 | B2 | 1/2004 | Caron et al. | |
| 6,991,401 | B1 | 1/2006 | Caron | |
| 7,108,452 | B2 * | 9/2006 | Caron et al. | 404/124 |
| 2002/0048489 | A1 * | 4/2002 | Caron et al. | 404/124 |
| 2003/0099513 | A1 | 5/2003 | Livesay et al. | |
| 2008/0196281 | A1 | 8/2008 | Livesay et al. | |
| 2009/0045669 | A1 | 2/2009 | McPhail et al. | |
| 2009/0313805 | A1 | 12/2009 | McPhail et al. | |

OTHER PUBLICATIONS

Macpactor Compaction Technologies website pages, http://www.macpactor.co.uk/index.php (1 page), http://www.macpactor.co.uk/index.php?substance=m-trax (1 page), http://www.macpactor.co.uk/index.php?substance=compax (1 page), Feb. 2, 2011.

Terra Compactor Wheel Corp. website pages, http://terra.smugmug.com/Portfolio/Terra-Compactor-Wheel/13948699_FaU2z#P-1-10 (5 pages), http://terra.smugmug.com/Portfolio/Terra-Compactor-Wheel/13948699_FaU2z#P-2-10 (5 pages), http://terra.smugmug.com/Portfolio/Terra-Compactor-Wheel/13948699_FaU2z#P-3-10 (5 pages), http://terra.smugmug.com/Portfolio/Terra-Compactor-Wheel/13948699_FaU2z#P-4-10 (7 pages), http://terra.smugmug.com/Portfolio/Terra-Compactor-Wheel/13948699_FaU2z#P-5-10 (7 pages), Feb. 2, 2011.

* cited by examiner

LAND FILL COMPACTOR WHEEL TIP ASSEMBLY

TECHNICAL FIELD

This disclosure relates generally to wheel tips for landfill and soil compactors.

BACKGROUND

Landfill compactors are machines which move over landfill deposits to compact the trash. Compacting the trash maximizes the use of the landfill. When the trash is compacted, more material can be disposed in the landfill because it is deposited more densely. Compacting the trash also helps to ensure long term structural stability of the landfill when it is filled and capped with soil. Similarly, soil compactors are machines which move over soil, gravel, or other materials to compact the material in preparation for road construction or other construction purposes.

Landfill compactors and soil compactors typically feature large, heavy steel wheels. The bodies of the machines are also heavy, and the combined weight of the body and the set of wheels on each machine provides the necessary downward force for compaction. To increase the compactive capability, compactor wheels have often been fitted with tips to concentrate the weight force. This is especially common on landfill compactors, where the tips help compact the trash by breaking and grinding it into smaller pieces. The tips are mounted on the cylindrical, ground facing surface of the wheels which is often formed by a wheel wrapper, a relatively thick section of plate steel that is bent around and welded to the wheel hub. The tips extend radially outward from the wheel wrapper in a direction away from the center rotational axis of the wheel.

Many different landfill compactor tips have been developed for use on compactor wheels. One example of a compactor tip is disclosed in U.S. Pat. No. 3,891,341, issued Jun. 24, 1975, and has a generally square base with a work face having a "dog-bone" outline with larger dimensions extending axially of the wheel. Another example of a compactor tip provided by U.S. Pat. No. 4,074,942, issued Feb. 21, 1978, has a cross-shaped tip portion with tapered or concave surfaces extending downwardly to a generally rectangular body portion. U.K. Patent Appl. Publ. GB 2 214 878, published on Sep. 13, 1989, teaches a generally flat plate-like paddle mounted on a compactor wheel and supported on one side by a wedge or gusset. In a further example, U.S. Pat. No. 5,358,355, issued Oct. 25, 1994, teaches a cleat having sides sloping downward from a cutting face towards a bottom face, and generally toward opposite ends of the cleat, to produce a generally inverted wedge or V-shaped appearance of the cleat. As another example, U.S. Pat. No. 6,619,883, issued Sep. 16, 2003, provides a compactor tooth having a ground engaging surface with a "plus-" symbol profile that increases in cross-section in the forward and rearward directions as the tooth extends from the tip downward toward a mounting block.

As discussed above, these and other compactor wheel tips are provided to improve the compaction of the trash and the soil over which the compactor machines are driven. Compaction is important in the landfill environment because a landfill has a finite amount of space available, so the more densely the trash can be compacted, the more efficiently the space is used, and the more profitable the landfill as a going concern. Consequently, optimizing the compaction achieved by a wheel tip is a consideration for those skilled in the art when designing wheel tips. Closely related to the issue of compaction is the concept of "fluffing." Fluffing is the tendency of a particular wheel tip or wheel tip assembly to pull the material back up as the tip is exiting the surface of the compacted material, and thereby undoing a certain amount of compaction that was achieved by the tip. Fluffing may be caused by material sticking to the tip and being pulled up as the wheel rotates away from the surface. Fluffing may also occur where edges of the tip engage the material as the tip rotates out of the hole in the surface. The smallest amount of fluffing may be undesirable.

The traction provided by the wheel tips is also a factor considered by those skilled in the art when designing the tips. Traction is important because it allows the machine to move through the trash and to perform the task of compacting the trash or the soil. Traction is more perceivable by the operator of the machines than compaction, but both factors are important in the design of the tip. Traction causing the wheels to propel the machine forward over the surface with minimal slippage is of primary concern. Additionally, traction against lateral slippage, such as can occur when the machine is on the side-slope of a hill, is also an important consideration in compactor wheel tip design.

Packing refers to the adherence of material to the tips and the wheel as the compactor machine passes over the surface. As material packs on the wheel, just as when mud cakes on a shoe, the traction provided by the tips degrades and slippage of the wheels increases. Additional torque may be required to be applied to the wheels due to the added weight of the packed material. Some compactors are equipped with cleaner fingers to remove packed material between the tips, but not all can be removed. Consequently, minimizing the amount of material packing occurring to the wheels is a further consideration of the person skilled in the art performing compactor wheel tip design.

The surfaces over which the compactor machines travel includes abrasive materials that wear away the metal of the compactor wheel tip over time. Materials such as sand and rock may be harder than the metal from which the tips are fabricated, and the friction of the abrasive material removes metal from the tip. The wear rate is not uniform at all points on the compactor tip, so the ground engaging surface of the tip is reshaped over tip as more metal is removed from, for example, the lateral edges of the tips. It is desirable to have compactor tips designed to provide extended though not unlimited useful lives over which the tips provide an acceptable combination of traction and compaction, even as the abrasive materials wear away the metal of the compactor tips and reshape the ground engaging surface.

Several different attachment methods have been used to attach tips to compactor wheels. Welding tips to a compactor wheel is common. Mechanical retention systems have also been employed. For example, U.S. Pat. No. 6,619,883, issued on Sep. 16, 2003, discloses mechanically retaining a landfill compactor tip on a compactor wheel. As another example, U.S. Pat. No. 6,095,717, issued Aug. 1, 2000, discloses a different type of mechanical retention system. Mechanical retention systems, while permitting easy replacement of the tips after they are worn or damaged, can suffer from several disadvantages such as failure of the retention mechanism causing the tip to fall off, looseness of the connection causing movement of the tip leading to collection of debris between the tip and wheel, excessive wear, excessive vibration and noise, and increased frequency of failure.

Welding tips to compactor wheels is still an attractive option as an alternative to mechanical retention systems. However, welding also suffers disadvantages, such as the difficulty of producing a tip from steel with the most desirable metallurgy for durability and wear resistance, while still permitting a consistent, strong, and durable weld joint to be formed between the tip and the wheel. Highly durable and wear resistant steels are desirable in the landfill and soil compacting environments, but tips made from durable steels, such as high carbon and high alloy steels, are most often not easy to weld to the surface of the compactor wheel. Moreover, welding is further complicated where the compactor wheel and the tip are made from different steels. At the very least, creating a consistent, strong, and durable weld joint between a compactor tip and a compactor wheel made from dissimilar metals requires conditions that are difficult to create in the field where this welding often occurs, and may require skilled, experienced welders.

To avoid the difficulty of welding certain types of steels and of welding dissimilar steels, some manufacturers have avoided using highly durable and wear resistant steels. Rather, these manufacturers have used low carbon steels and relied on heat treating techniques to achieve the necessary hardness in the tip. But the need for heat treating appears to have also led to the tips being designed with a geometry that facilitates such heat treatments, but which is less than optimal for compacting. Another alternative manufacturing concept for facilitating attachment of tips to compactor wheels provided in U.S. Pat. Appl. Publ. No. 2009/0045669, published on Feb. 19, 2009, includes a compactor tip assembly having a base and tip that are formed from dissimilar materials. The tip may be formed from high carbon steel for wear resistance, while the base may be formed from low carbon steel for easy welding. The compactor tip assembly is attached to the wheel by welding the base to the wheel after the tip has been welded to the base, possibly at the factory where the conditions can be precisely controlled and repeated for a consistent, durable and strong weld joint as opposed to welding out in the field at the location of the compactor where conditions are less controllable. Even with such a two-piece construction, balancing factors such as durability, wear, traction, compaction, packing, fluffing and the like is important in developing the geometry of the compactor wheel tip.

For these reasons, a need exists for a new technology for compactor wheel tips that may balance these trade-offs to provide a compactor wheel tip that is durable and wear resistant, and provides an acceptable level of traction and compaction for the compactor wheel during the compaction wheel tip's useful life. A further need exists for providing a compactor wheel tip that is both durable and wear resistant, and easily weldable to a compactor wheel.

SUMMARY OF THE DISCLOSURE

According to certain aspects of this disclosure, a compactor wheel tip assembly includes a tip having a tip bottom wall having a base engaging surface, a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, and a pair of oppositely disposed tip side walls extending upwardly from the tip bottom wall to the tip top wall. The compactor wheel tip assembly also includes a base having a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, and a pair of oppositely disposed base side walls extending upwardly from the base bottom wall to the base top wall. The base engaging surface and the tip engaging surface have corresponding geometries so that the tip is attachable to the base with the tip and base engaging surfaces facing and abutting with either the pocket walls aligned with the front and rear walls or the pocket walls aligned with the base side walls, and the tip is attached to the base with the tip and base engaging surfaces facing and abutting with one of the pocket walls aligned with the front and rear walls and the pocket walls aligned with the base side walls.

In another aspect of the disclosure that may be combined with any of these aspects, the tip and the base are dimensioned such that the aligned walls of the tip and the base form substantially continuous surfaces when the pocket walls are aligned with the front and rear walls and when the pocket walls are aligned with the base side walls.

In another aspect of the disclosure that may be combined with any of these aspects, the distance between the tip side walls proximate the tip top wall is greater than the distance between the pocket walls proximate the tip top wall.

In another aspect of the disclosure that may be combined with any of these aspects, the base comprises a base interior surface defining a base opening through the base and extending from the base bottom wall through the base top wall, and wherein the tip comprises a tip interior surface defining an interior pocket of the tip extending upwardly from the tip bottom wall into the interior of the tip, wherein the base opening and the interior pocket align to form generally continuous interior walls within the compactor wheel tip assembly when the pocket walls are aligned with the front and rear walls of the base.

In another aspect of the disclosure that may be combined with any of these aspects, a compactor wheel tip assembly includes a tip having a tip bottom wall having a base engaging surface, a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, and a pair of oppositely disposed tip side walls extending upwardly from the tip bottom wall to the tip top wall. The compactor wheel tip assembly further includes a base having a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, and a pair of oppositely disposed base side walls extending upwardly from the base bottom wall to the base top wall. The base engaging surface and the tip engaging surface have corresponding geometries with the tip being attachable to the base with the tip and base engaging surfaces facing and abutting.

In another aspect of the disclosure that may be combined with any of these aspects, the tip is welded to the base.

In another aspect of the disclosure that may be combined with any of these aspects, the base engaging surface and the tip engaging surface have corresponding geometries so that the tip is attachable to the base with either the pocket walls aligned with the front and rear walls or the pocket walls aligned with the base side walls.

In another aspect of the disclosure that may be combined with any of these aspects, the tip is attached to the base with the pocket walls aligned with the base side walls.

In another aspect of the disclosure that may be combined with any of these aspects, portions of the pocket walls proximate the tip bottom wall extend outwardly from a first tip vertical plane bisecting the tip from pocket wall to pocket wall at a horizontal draft angle $\Delta$ with respect to a line perpendicular to the first tip vertical plane such that the distance between portions of the pocket walls decreases as the pocket walls extend outwardly from the first tip vertical plane toward the tip side walls, portions of the tip side walls proximate the tip bottom wall extend outwardly from a second tip vertical plane bisecting the tip from side to side at the horizontal draft angle Δ with respect to a line perpendicular to the second tip vertical plane such that the distance between the portions of the tip side walls decreases as the tip side walls extend outwardly from the second tip vertical plane toward the pocket walls, portions of the front and rear walls proximate the base top wall extend outwardly from a first base vertical plane bisecting the base from front to rear at the horizontal draft angle Δ with respect to a line perpendicular to the first base vertical plane such that the distance between the portions of the front and rear walls decreases as the front and rear walls extend outwardly from the first base vertical plane toward the base side walls, and portions of the base side walls proximate the base top wall extend outwardly from a second base vertical plane bisecting the base from side to side at the horizontal draft angle Δ with respect to a line perpendicular to the second base vertical plane such that the distance between the portions of the base side walls decreases as the base side walls extend outwardly from the second base vertical plane toward the front and rear walls.

In another aspect of the disclosure that may be combined with any of these aspects, the horizontal draft angle Δ is approximately 10°.

In another aspect of the disclosure that may be combined with any of these aspects, the pocket walls each have a curved portion having a curvature causing the distance between the pocket walls to decrease as the curved portions extend upwardly away from the tip bottom wall and toward the tip top wall, and wherein the curved portions of each of the pocket walls extend outwardly from the first tip vertical plane at a pocket angle Φ with respect to a line perpendicular to the first tip vertical plane such that the distance between the curved portions increases as the pocket walls extend outwardly from the first tip vertical plane toward the tip side walls. In another aspect of the disclosure that may be combined with any of these aspects, the pocket angle Φ has a value in the range of 2.5° to 5.5°.

In another aspect of the disclosure that may be combined with any of these aspects, the ground engaging surface defines a pair of shoulders each extending inwardly from a corresponding one of the tip side walls, a rib extending between the shoulders, and a pair of external pockets disposed on opposite sides of the rib and extending between the shoulders, wherein the external pockets extend downwardly between the rib and corresponding portions of the pocket walls.

In another aspect of the disclosure that may be combined with any of these aspects, the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is parallel to a rotational axis of the compactor wheel to which the compactor wheel tip assembly will be attached.

In another aspect of the disclosure that may be combined with any of these aspects, the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is not parallel to a rotational axis of the compactor wheel to which the compactor wheel tip assembly will be attached, with the vertical plane being offset from the rotational axis by an offset angle Θ.

In another aspect of the disclosure that may be combined with any of these aspects, the offset angle Θ is approximately 45°.

In another aspect of the disclosure that may be combined with any of these aspects, the offset angle Θ is in the range of 5° to 45°.

In another aspect of the disclosure that may be combined with any of these aspects, the In another aspect of the disclosure that may be combined with any of these aspects, the pocket walls each have a curved portion having a curvature causing the distance between the pocket walls to decrease as the curved portions extend upwardly away from the tip bottom wall and toward the tip top wall, the curved portions of each of the pocket walls extend outwardly from a first tip vertical plane bisecting the tip from pocket wall to pocket wall at a pocket angle Φ with respect to a line perpendicular to the first tip vertical plane such that the distance between the curved portions increases as the pocket walls extend outwardly from the first tip vertical plane toward the tip side walls, and the offset angle Θ is approximately equal to the pocket angle Φ.

Additional aspects of the invention are defined by the claims of this patent.

DETAILED DESCRIPTION

Figure 1:
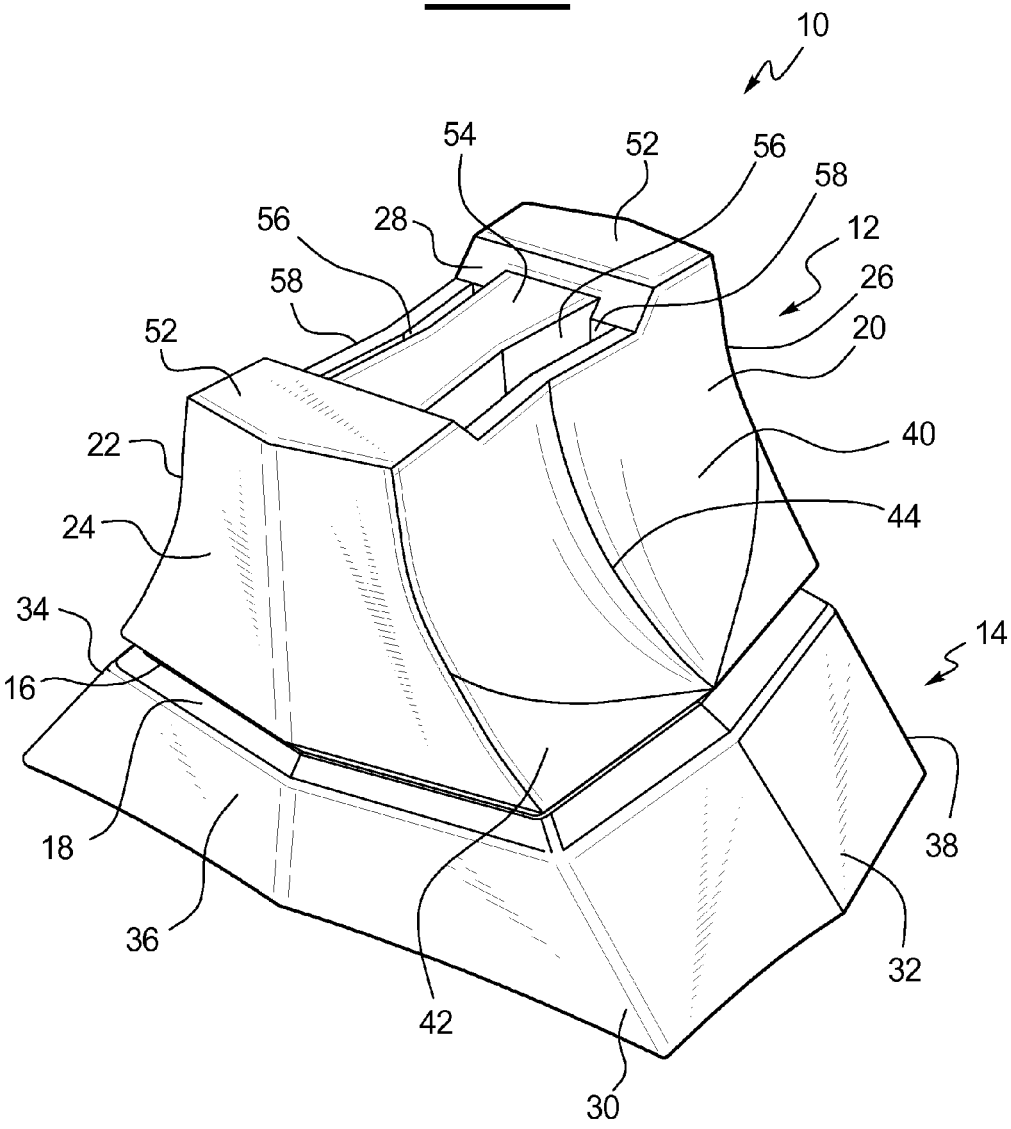
FIGS. 1 and 2 are top and bottom pictorial views of a landfill compactor wheel tip assembly comprising a tip and a base.

The following is a detailed description of exemplary embodiments of the invention. The exemplary embodiments described herein and illustrated in the drawing figures are intended to teach the principles of the invention, enabling those of ordinary skill in this art to make and use the invention in many different environments and for many different applications. Therefore, the exemplary embodiments are not intended to be, and should not be considered as a limiting description of the scope of patent protection. Rather, the scope of patent protection shall be defined by the appended claims.

A compactor tip assembly 10 is illustrated in the accompanying drawing figures which may be formed in part with highly durable and wear resistant steel, yet still may permit a consistent, strong, and durable weld joint to a compactor wheel. The compactor tip assembly 10 is formed by a tip 12 joined to a base 14. The tip 12 may be formed from a material such as steel, titanium carbide and the like selected to provide desirable wear performance for landfill or soil compacting. The base 14 may be formed from a softer steel or other material selected for excellent welding characteristics to permit easy welding of the tip assembly 10 to a compactor wheel. The tip 12 and base 14 may be separately manufactured, permitting the use of dissimilar materials and processes. The tip 12 and base 14 may then be welded together in factory conditions where the quality of the weld between the components can be assured. After the tip 12 and base 14 are joined together, the compactor tip assembly 10 is ready for installation. The compactor tip assembly 10 may be attached to a compactor wheel by welding the base 14 to the compactor wheel. Because the base 14 can be made from a steel selected for excellent welding characteristics, the weld between the tip assembly 10 and the compactor wheel can be consistent, strong, and durable, can be made more easily in field conditions, and can be made by relatively less skilled welders.

Figure 2:
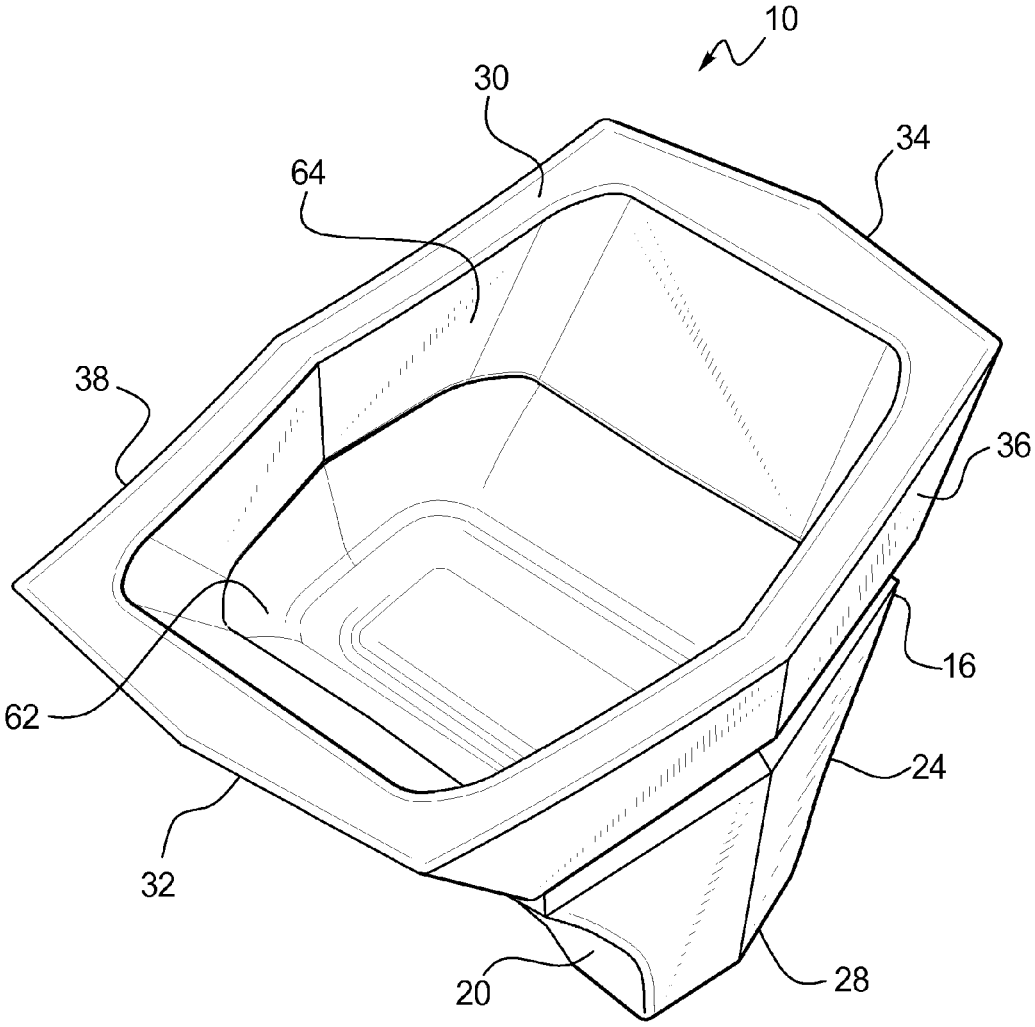

FIGS. 1 and 2 illustrate one embodiment of the compactor wheel tip assembly 10 in accordance with the present disclosure. The compactor wheel tip assembly 10 may be designed to provide a desirable combination of compaction of trash or soil over which the compactor passes, traction between the wheels and the surface over which the compactor travels in the direction of travel and laterally, and absence of packing of the compacted material onto the surfaces of the compactor wheel tip assemblies 10 and the wheel itself. As shown in the drawing figures, the tip 12 of the compactor wheel tip assembly 10 in the embodiment may include generally concave front and rear pocket walls tapering inwardly from the base 14 to the top of the tip 12. The concavity of the pocket walls may improve the ability of the tip 12 to cup the material over which the wheel passes and propel the compactor forward with reduced slippage. At the same time, the concavity and tapering may reduce the adherence of material to the surfaces of the compactor wheel tip assembly 10 to reduce packing of material on the assembly 10 and wheel and fluffing at the surface as the compactor wheel tip assembly 10 rolls out of the compacted material. Additionally, the ground engaging surface of a top wall of the tip 12 may be designed to present a relatively large surface area for greater compaction of the trash or soil as the wheel roll over the surface. The ground engaging surface may also have additional metal distributed toward the lateral sides of the tip 12 where metal is expected to wear away at a faster rate, thereby prolonging the useful life of the compactor wheel tip assembly 10.

Figure 3:
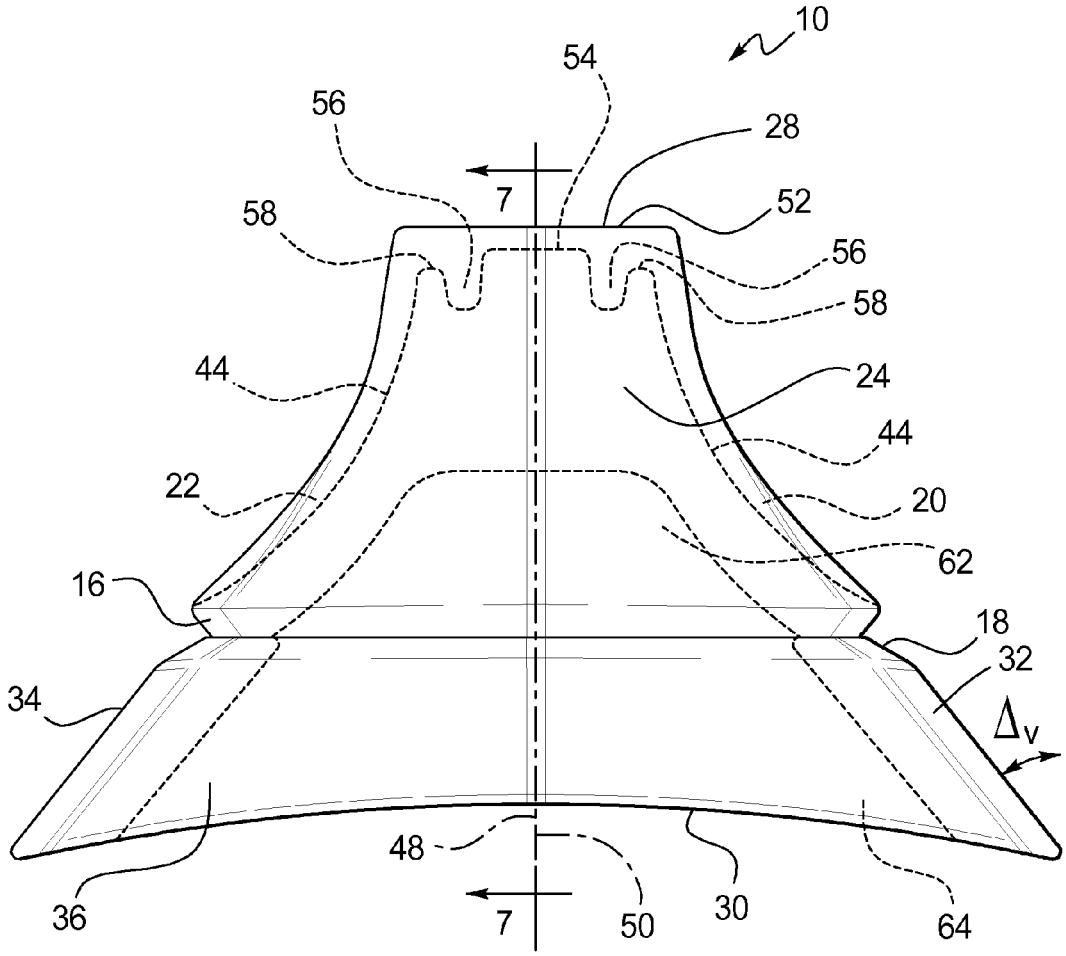
FIG. 3 is a side view of the compactor wheel tip assembly of FIG. 1.

The tip 12 of the compactor wheel tip assembly 10 may include a bottom wall 16 having a base engaging surface that may face and be secured to a corresponding tip engaging surface of a top wall 18 of the base 14, oppositely disposed front and rear pocket walls 20, 22, respectively, and oppositely disposed side walls 24, 26 extending upwardly from the bottom wall 16 and terminating at a top wall 28 having a ground engaging surface. The base 14 may have a complimentary shape to the tip 12, and may include a bottom wall 30 having a wheel engaging surface that may face and be secured to a corresponding portion of the wheel, oppositely disposed front and rear walls 32, 34, respectively, and oppositely disposed side walls 36, 38 extending upwardly from the bottom wall 30 and terminating at the top wall 18 of the base 14. The wheel engaging surface of the base bottom wall 30 may be shaped to conform to the surface of the compactor wheel to which the compactor wheel tip assembly 10 may be attached. Consequently, the portions of the wheel engaging surface proximate the side walls 36, 38 may have a curvature from front to back corresponding the curvature of the perimeter of the wheel as best seen in FIG. 3.

Returning to FIGS. 1 and 2, the pocket walls 20, 22 of the tip 12 may each have a generally concave shape such that the trash or soil engaged thereby may be cupped as the wheel rolls over the surface in a similar manner as swimmer's hands cup the water as the swimmers propel themselves through the water. Each of the pocket walls 20, 22 may include a generally concave top portion 40 and generally convex bottom portion 42. The side view of FIG. 3 further illustrates the curvature of the pocket walls 20, 22. The pocket walls 20, 22 extend upwardly from the bottom wall 16 with a curvature causing the distance between the pocket walls 20, 22 to decrease as the concave portion 40 extends toward the top wall 28. Due to the curvature, the rate of decrease in the distance lessens as the walls 20, 22 approach the top wall 28. In standard implementations, the compactor wheel tip assembly 10 may be approximately 7 inches (approximately 17.78 centimeters) tall, and the pocket walls 20, 22 may be provided with a radius of curvature of approximately 160 mm (approximately 6.25 inches).

To further develop the concavity of the pocket walls 20, 22 of the compactor wheel tip 12, the concave portions 40 may be provided with pocket angles creating an effect wherein an approximate centerline 44 of each of the walls 20, 22 is recessed inwardly within the tip 12, and the lateral side edges of the corresponding portions of the walls 20, 22 extend more forwardly and rearwardly, respectively. As shown in the top view of FIG. 4, the compactor wheel tip assembly 10 of the present embodiment may be bisected from front to back by a first vertical plane 46 extending through the center of the tip assembly 10. The surfaces of the concave portions 40 of the walls 20, 22 may extend outwardly from the first vertical plane 46 at a pocket angle $\Phi_W$ with respect to a line perpendicular to the first vertical plane 46 such that the distance between the walls 20, 22 increases as the pocket walls 20, 22 approach the side walls 24, 26. The pocket angle $\Phi_W$ may have a value up to approximately 10°, and may be within the range from 2.5° to 5.5°, such as angles of approximately 3° or approximately 5°. The pocket angle $\Phi_W$ along with the curvature of the concave portions 40 combine to form concave exterior pockets of the pocket walls 20, 22 that may improve traction by cupping the material over which the compactor machine passes to propel the compactor forward, and may promote even wear of the tip 12 by distributing more metal to the lateral edges of the walls 20, 22 where metal of the tip 12 may be worn away at a faster rate.

While the pocket angle $\Phi_W$ of the concave portions 40 may create concavity, extending the pocket angle $\Phi_W$ to the bottom portions 42 of the pocket walls 20, 22 and to the base front and rear walls 32, 34 may have the adverse affect of promoting packing along the edges of attachment of the base bottom wall 30 to the wheel. The issue of packing is addressed at least partially by having the convex portions 42 and the base walls 32, 34 present a generally convex surface tending to direct material toward the sides of the compactor wheel tip assembly 10 as a deterrent to packing along the welds formed at the front and rear edges of the base 14. The convex shape may be achieved by having the convex portions 42 of the pocket walls 20, 22 extend outwardly from the first vertical plane 46 at a draft angle $\Delta_F$ with respect to a line perpendicular to the first vertical plane 46 such that the distance between the pocket walls 20, 22 decreases as the walls 20, 22 approach the side walls 24, 26. As with the pocket angle $\Phi_W$, the draft angle $\Delta_F$ may have a value up to approximately 10°, and may be within the range from 2.5° to 5.5°, such as angles of approximately 3° or approximately 5°, to provide the desired convex surface of the convex portions 42.

The base front and rear walls 32, 34 may also have a convex shape corresponding to the shape of the convex portions 42 of the pocket walls 20, 22. As best illustrated in the top view of FIG. 4, the walls 32, 34 may be formed with the same draft angle $\Delta_F$ with respect to a line perpendicular to the first vertical plane 46 as the convex portions 42 of the pocket walls 20, 22. The correspondence between the shapes of the pocket walls 20, 22 and base walls 32, 34 is further illustrated in FIG. 3. The base walls 32, 34 may be sloped at a draft angle $\Delta_V$ with respect to a vertical line such that the base walls 32, 34 and pocket walls 20, 22 define generally continuous front and rear surfaces of the tip assembly 10 when the tip 12 and base 14 are assembled as shown. The tip bottom wall 16 and base top wall 18 may be slightly beveled and define a V-shaped groove in which a V-groove weld is made to secure the tip 12 to the base 14.

While exterior pockets having the desired concavity may be formed in the walls 20, 22 by the combination of the curvature of the concave portion 40 and the pocket angle $\Phi_W$, those skilled in the art will understand that a desired amount of concavity may be achieved using various combinations of curvature and pocket angles $\Phi_W$. For example, the curvature of the concave portion 40 may be eliminated, and the concave portion 40 may present a generally flat, planar surface extending toward the top wall 28 with the exception of the pocket angles $\Phi_W$ contributing to the concavity of the walls 20, 22. Conversely, the pocket angles $\Phi_W$ of the concave portions 40 may be eliminated while maintaining the curvature of the concave portion 40. As a further alternative, the surfaces of the concave portions 40 may have a concave curvature as the walls 20, 22 extend toward the side walls 24, 26 from the centerlines 44 of the walls 20, 22, even to the extent of having a continuous curvature from side wall 24 to side wall 26 without a discernible centerline 44.

Additional configurations of the concave portions 40 forming generally concave surfaces of the walls 20, 22 will be apparent to those skilled in the art, and are contemplated by the inventors as having use in compactor wheel tip assemblies in accordance with present disclosure. Moreover, while the pocket walls 20, 22 are illustrated as being symmetrical about the first vertical plane 46, it is contemplated that the walls 20, 22 may have generally concave shapes that are not symmetrical about a central vertical plane extending through the walls 20, 22. For example, the centerlines 44 may not necessarily be centered between the side walls 24, 26, and instead may be offset toward one of the side walls 24, 26 or the other, but with the general concavity of the pocket walls 20, 22 being maintained.

Figure 5:
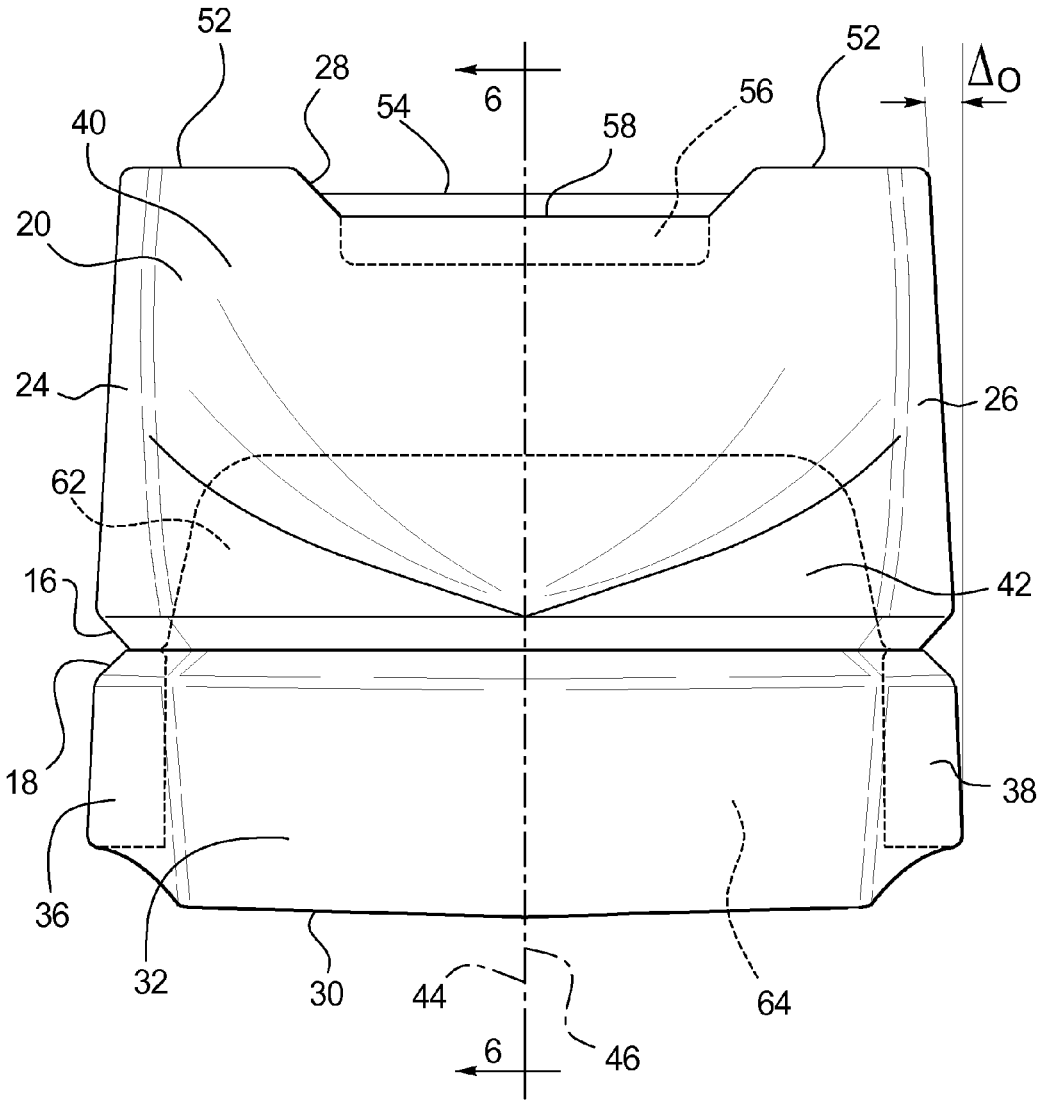
FIG. 5 is a front view of the compactor wheel tip assembly of FIG. 1.
Figure 6:
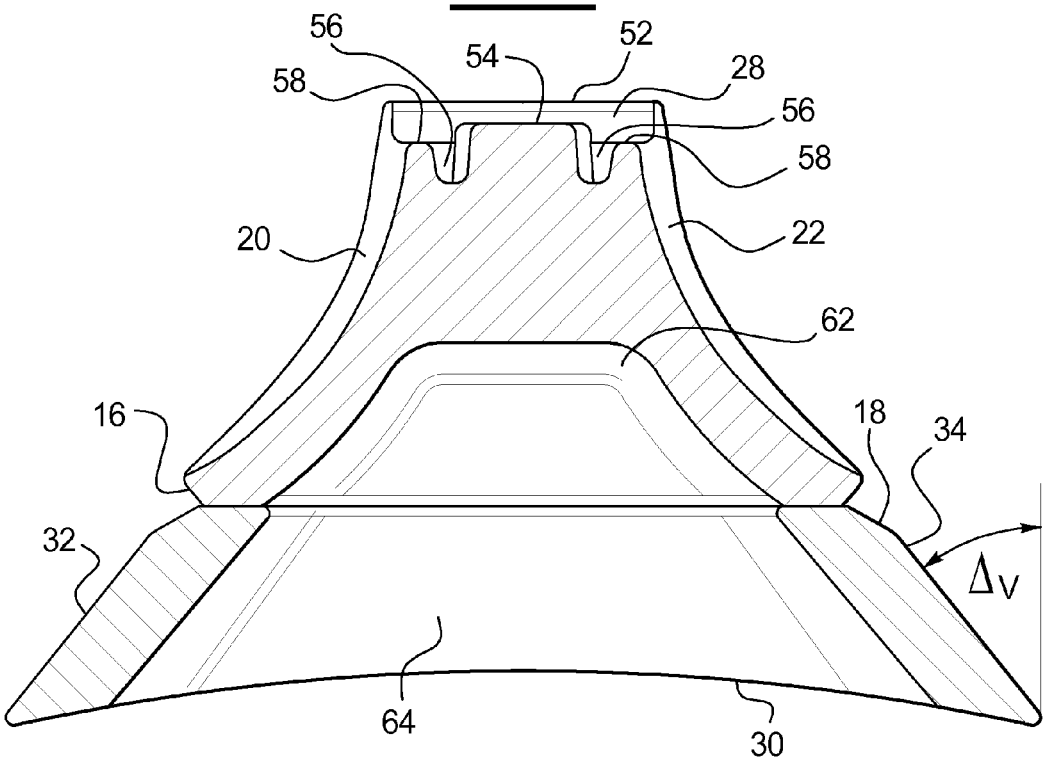
FIG. 6 is a cross-sectional view taken through line 6-6 in FIG. 5 of the compactor wheel tip assembly of FIG. 1.

The tip side walls 24, 26 and the base side walls 36, 38 extend generally vertically from the bottom walls 16, 30, respectively, and may have an outer vertical draft angle $\Delta_O$ with respect to a vertical line as shown in FIG. 5 providing the side walls 24, 26, 36, 38 with a slight inward taper to facilitate removal of the tip 12 and base 14 from their molds during the molding or casting processes. The draft angle $\Delta_O$ may be up to approximately 10°, with the draft angle $\Delta_O$ of approximately 3° being shown in FIG. 5. The tip 12 may have a narrower width than the base 14 such that the base side walls 36, 38 and tip side walls 24, 26 define generally continuous side surfaces of the tip assembly 10 when the tip 12 and base 14 are assembled as shown. The side portions of the tip bottom wall 16 and base top wall 18 may be slightly beveled as discussed above to define the V-shaped grooves on the sides of the tip assembly 10 in which V-groove welds are made to secure the tip 12 to the base 14.

Figure 4:
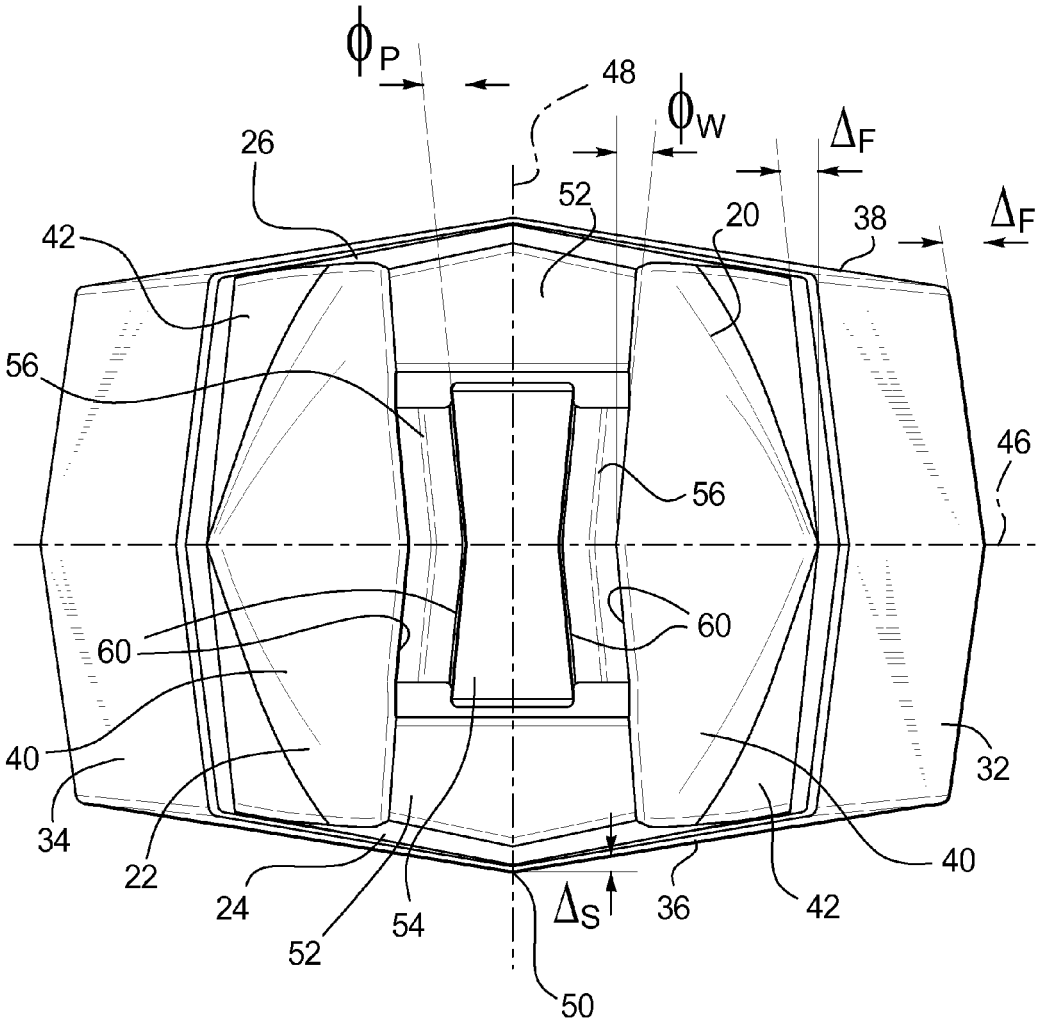
FIG. 4 is a top view of the compactor wheel tip assembly of FIG. 1.

The side walls 24, 26, 36, 38 may also provide slightly convex side surfaces for the compactor wheel tip assembly 10 as shown in FIGS. 1, 2 and 4. As shown in the top view of FIG. 4, the compactor wheel tip assembly 10 may be bisected from side to side by a second vertical plane 48 extending through approximate centerlines 50 of the side walls 24, 26, 36, 38. The surfaces of the side walls 24, 26, 36, 38 may extend outwardly from the second vertical plane 48 at a side draft angle $\Delta_S$ with respect to a line perpendicular to the second vertical plane 48 such that the distance between the side walls 24, 26, 36, 38 decreases as the walls 24, 26, 36, 38 approach the pocket walls 20, 22 and the front and rear walls 32, 34, respectively. The draft angle $\Delta_S$ may have a value up to approximately 10°, and may be within the range from 2.5° to 5.5°, such as angles of approximately 3° or approximately 5°, to provide the desired convex surface of the side walls 24, 26, 36, 38. Moreover, the draft angle $\Delta_S$ may have a value approximately equal to the value of the draft angle $\Delta_F$. The side draft angle $\Delta_S$ may provide the benefit of promoting self-cleaning of the compactor wheel tip assembly 10 and reducing packing as the contoured sides 24/36, 26/38 allow the material to slide along the sides 24/36, 26/38 and direct the material outwardly to keep the sides 24/36, 26/38 of the tip assembly 10 and corresponding portions of the wheel clean. As with the centerlines 44, the centerlines 50 need not necessarily be centered between the pocket walls 20, 22 and the front and rear walls 32, 34 while retaining the generally convex surfaces of the side walls 24, 26, 36, 38.

Returning to FIG. 1, the ground engaging surface of the tip top wall 28 of the tip 12 may be configured to provide desired wear characteristics and for optimal compaction of the material over which the compactor machine passes. In the illustrated embodiment, the ground engaging surface of the top wall 28 may be contoured to define a pair of shoulders 52 each extending inwardly from the corresponding side walls 24, 26, and a rib 54 extending between the shoulders 52. The shoulders 52 may extend the entire thickness of the top wall 28 from the pocket wall 20 to the pocket wall 22, while the rib 54 may be narrower, with outer edges disposed inwardly from the pocket walls 20, 22. The ground engaging surface may further define a pair of exterior pockets 56 disposed on opposite sides of the rib 54 and extending between the shoulders 52. The exterior pockets 56 may extend downwardly below the shoulders 52 and rib 54 and between the rib 54 and corresponding portions of the pocket walls 20, 22. The intersecting portions of the top wall 28 and the pocket walls 20, 22 proximate the exterior pockets 56 may define upper edges 58 of the respective exterior pockets 56. As best seen in FIGS. 1 and 5-7, the ground engaging surface may define the shoulders 52, rib 54 and exterior pockets 56 such that the shoulders 52 are higher than the rib 54, and the rib 54 is higher than the upper edges 58 of the pockets 56. In embodiments where the tip 12 is formed by casting, sharper corners and edges may be formed than in a forged tip and having corner radii of less than 8 millimeters (0.315 inch). Sharper corners provide an increased amount of corner material for reducing rounding, and promote penetration into the surface and cutting of scrap material in the landfill.

The top wall 28 is the primary wear surface of the compactor wheel tip assembly 10. Consequently, the shaping of the ground engaging surface affects the anticipated useful life of the tip assembly 10 and the effectiveness of the tip assembly 10 to compact the soil and to provide traction for the compactor wheel during that lifetime. Over time, the metal at the lateral sides of compactor wheel tips may wear away at up to three times the rate of the metal towards the middle of the tip. By lowering the rib 54 and defining the pockets 56 of the ground engaging surface, additional wear metal may be provided at the shoulders 52 to address the disparity in wear rates without increasing the overall metal and weight of the compactor wheel tip assembly 10. After a period of use, the shoulders 52 may wear down and lose the sharpness of the corners, and eventually the shoulders 52 wear down to the level of the rib 54. At that point, however, the ground engaging surface self-sharpens and reshapes into a wedge shape that may still provide sufficient traction for the compactor wheel.

Though defining voids in the ground engaging surface, the exterior pockets 56 of the top wall 28 may assist in slowing the wear rate at the top wall 28. As the compactor wheel tip assembly 10 digs into the surface, material is packed into the exterior pockets 56. The packed material has the abrasiveness to wear away the metal of the top wall 28 over time, and therefore should possess a natural abrasion resistance that is greater than metals from which the compactor wheel tip assembly 10 is fabricated. As a result, the material packed in the exterior pockets 56 may function to slow the overall wear rate of the ground engaging surface. The exterior pockets 56 may further be configured to preserve the useful life of the exterior pockets 56 before the side walls wear away or break down and thereby eliminate containment of the abrasion resistant material. As discussed above, the edges 58 of the exterior pockets 56 are lower than the rib 54, thereby reducing the wear rate on the edges 58 until the rib 54 is partially worn away, and reducing the potential for barrier damage to the walls beneath the pocket edges 58. Additionally, as shown in the top view of FIG. 4, interior walls 60 of the exterior pockets 56 may extend outwardly from the first vertical plane 46 of the tip assembly 10 at a pocket angle $\Phi_P$ that may be approximately equal to the pocket angle $\Phi_W$ of the pocket walls 20, 22. The correspondence between the pocket angle $\Phi_P$ and the pocket angle $\Phi_W$ may result in relatively uniform thickness of the metal between the exterior pockets 56 and the pocket walls 20, 22 and uniform wear to prolong the useful life of the exterior pockets 56 for containment of the abrasion resistant material.

Figure 7:
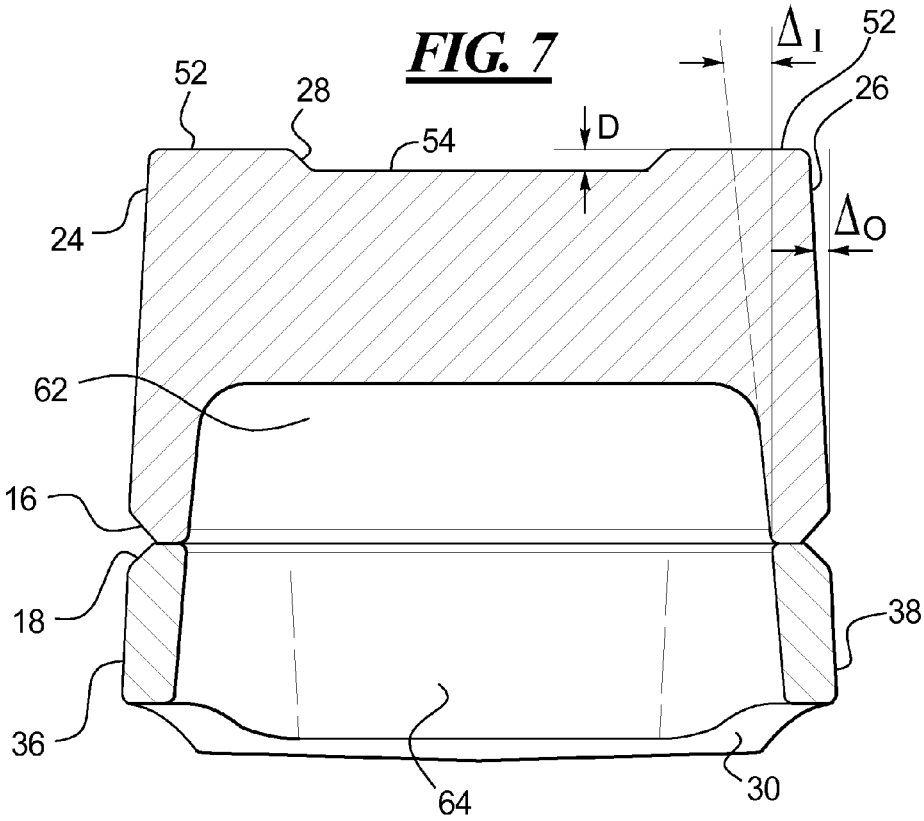
FIG. 7 is a cross-sectional view taken through line 7-7 in FIG. 3 of the compactor wheel tip assembly of FIG. 1.
Figure 8:
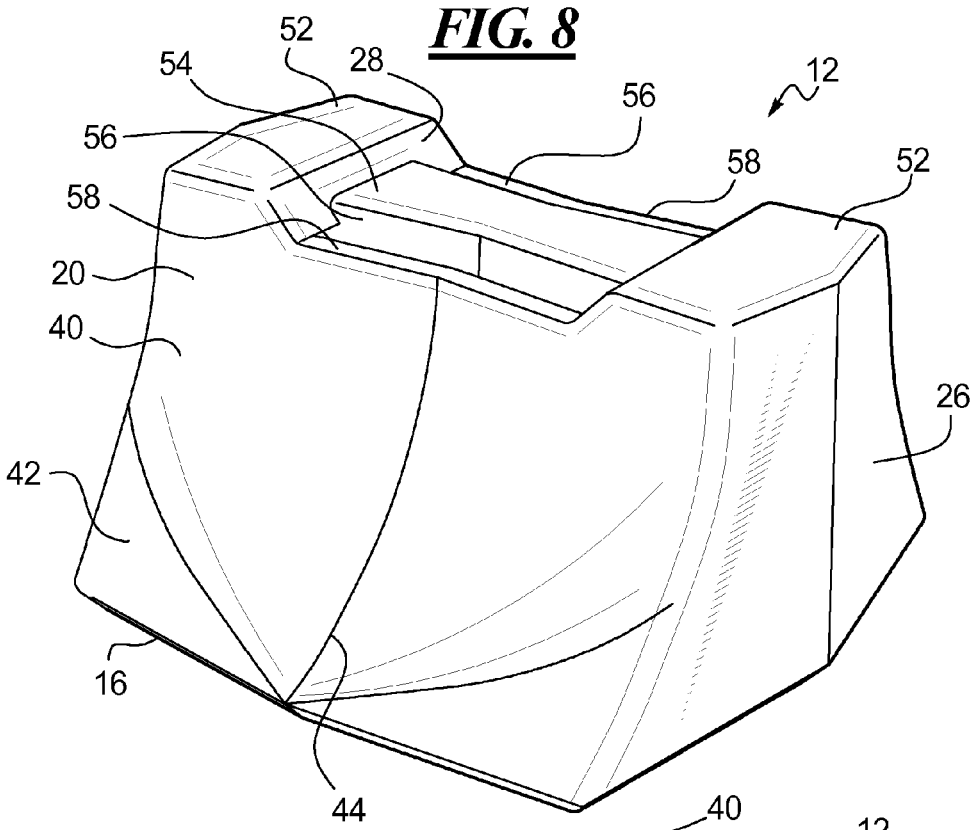
FIGS. 8 and 9 are top and bottom pictorial views of the tip of the compactor wheel tip assembly of FIG. 1.
Figure 9:
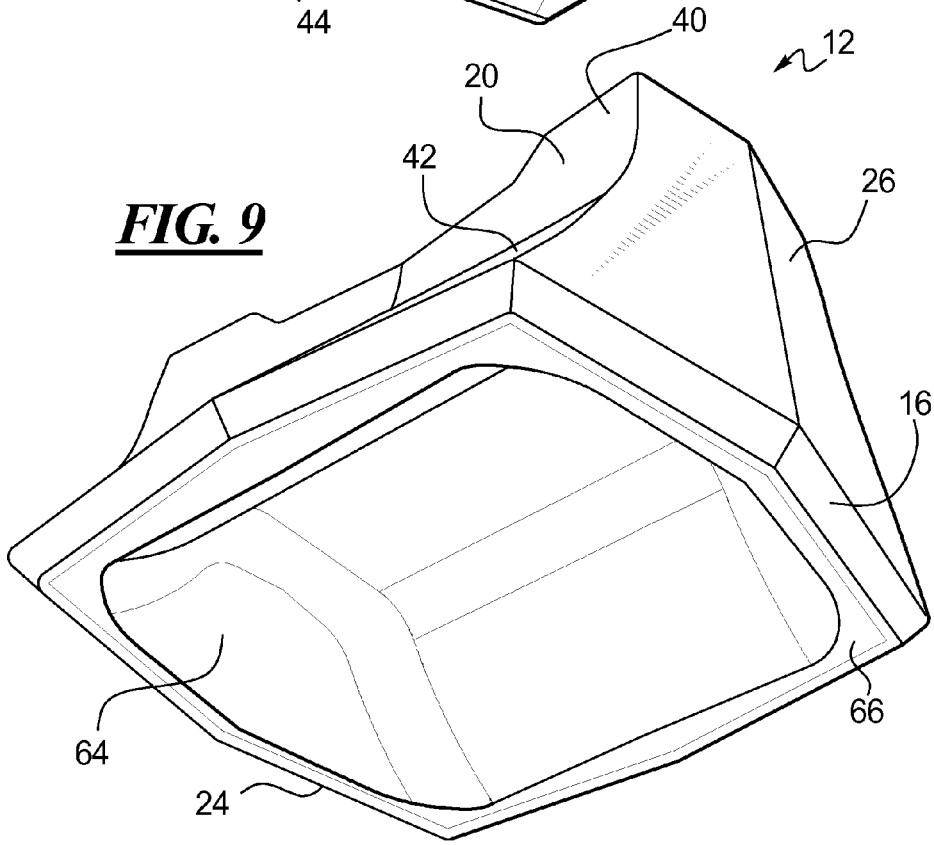
Figure 10:
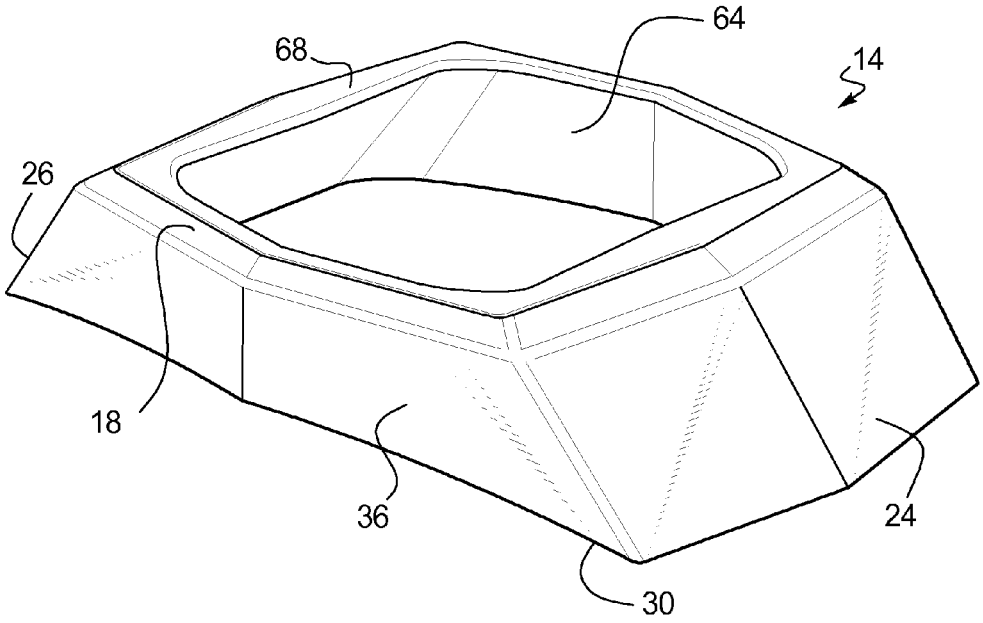
FIGS. 10 and 11 are top and bottom pictorial views of the base of the compactor wheel tip assembly of FIG. 1.
Figure 11:
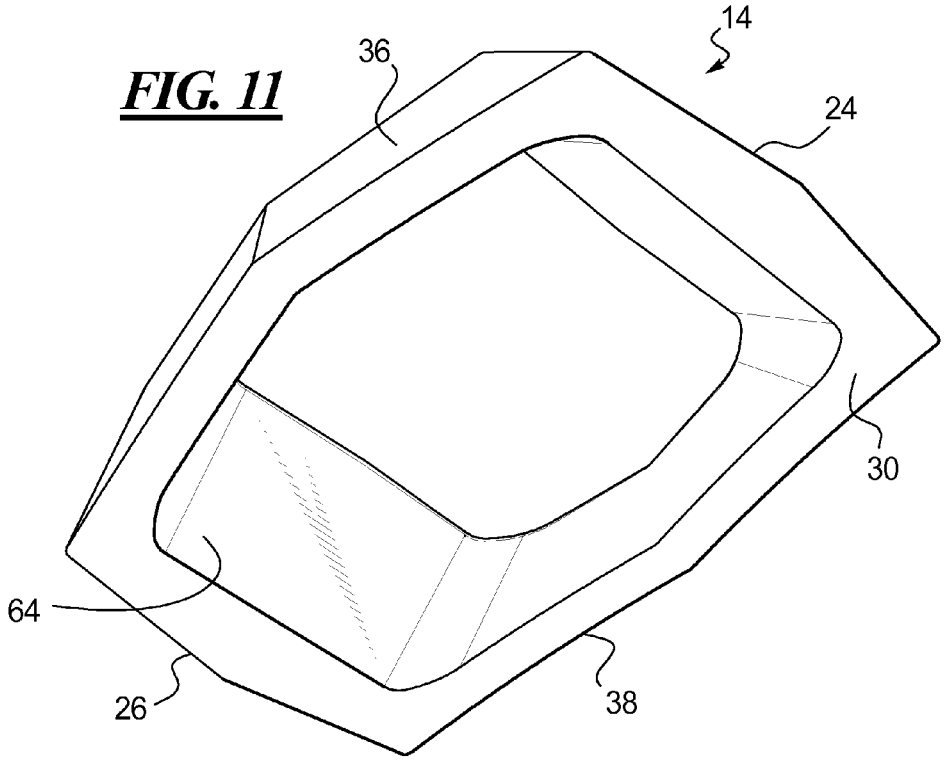
Figure 12:
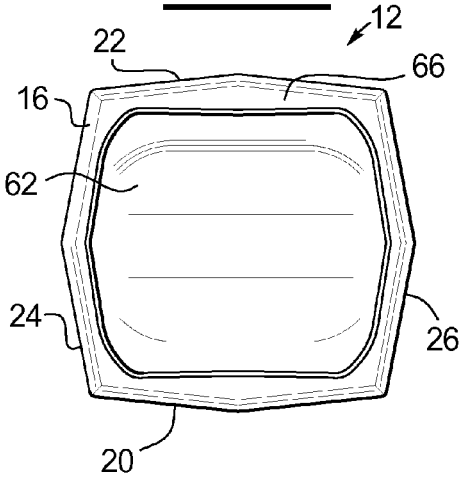
FIG. 12 is a bottom view of the tip of FIGS. 8 and 9.
Figure 13:
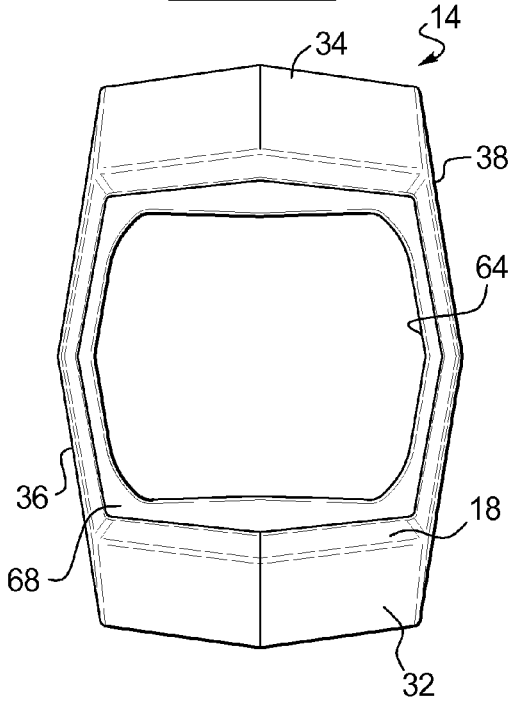
FIG. 13 is a bottom view of the base of FIGS. 10 and 11.
Figure 15:
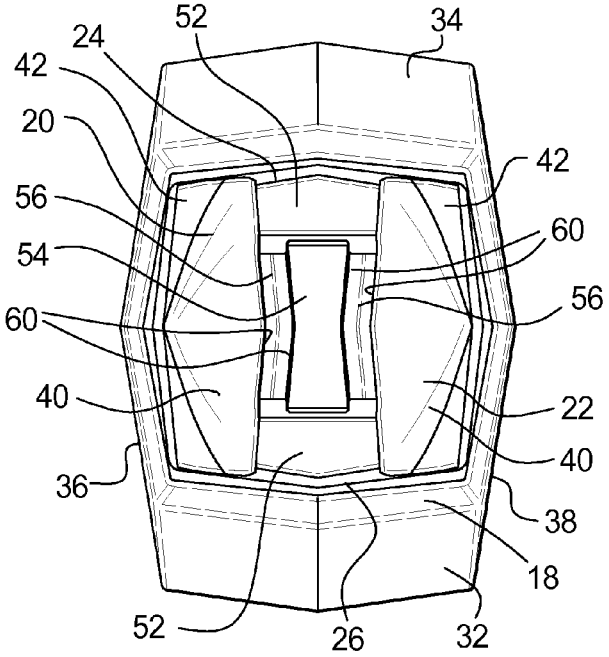
FIG. 15 is a top view of the compactor wheel tip assembly of FIG. 14.
Figure 14:
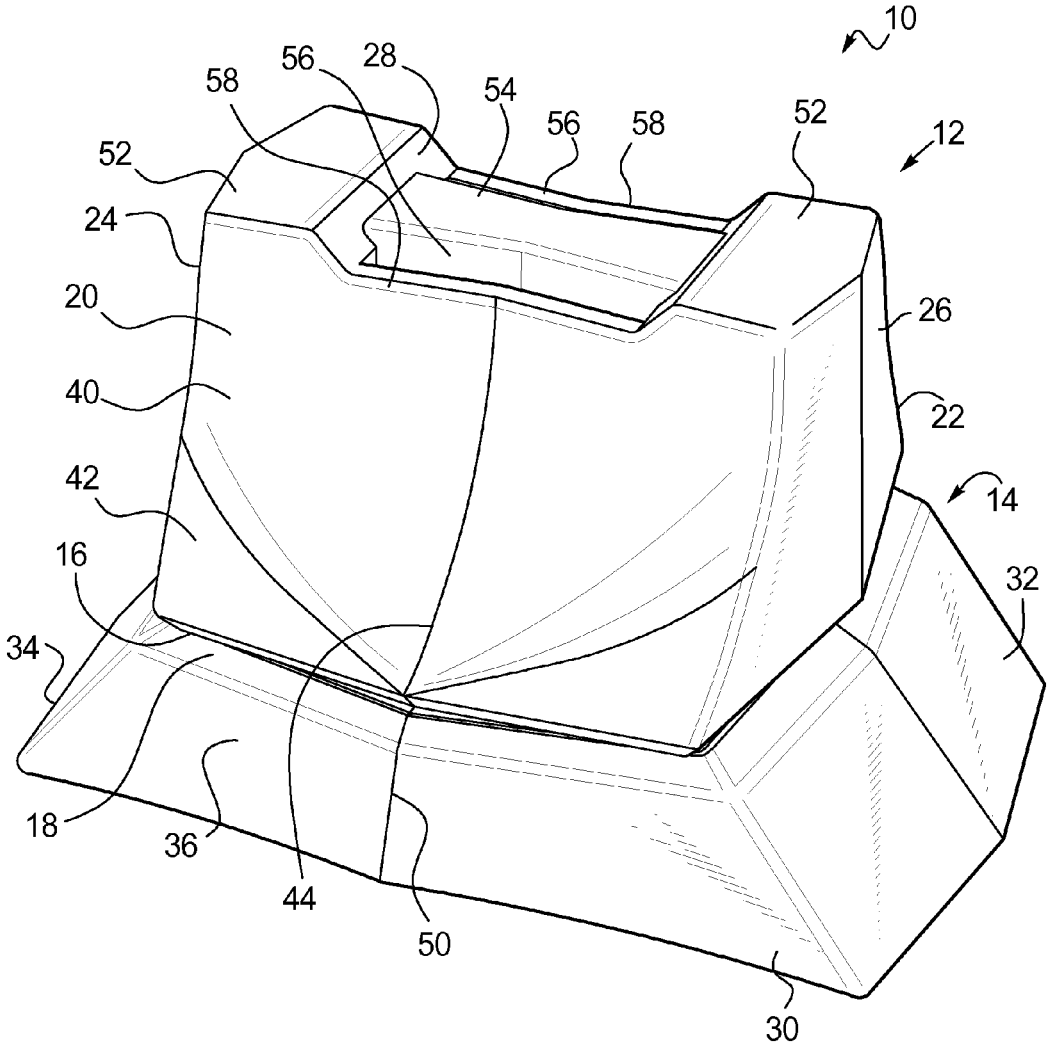
FIG. 14 is a top pictorial view of the compactor wheel tip assembly of FIG. 1 with the tip rotated to a side-slope traction position.
Figure 16:
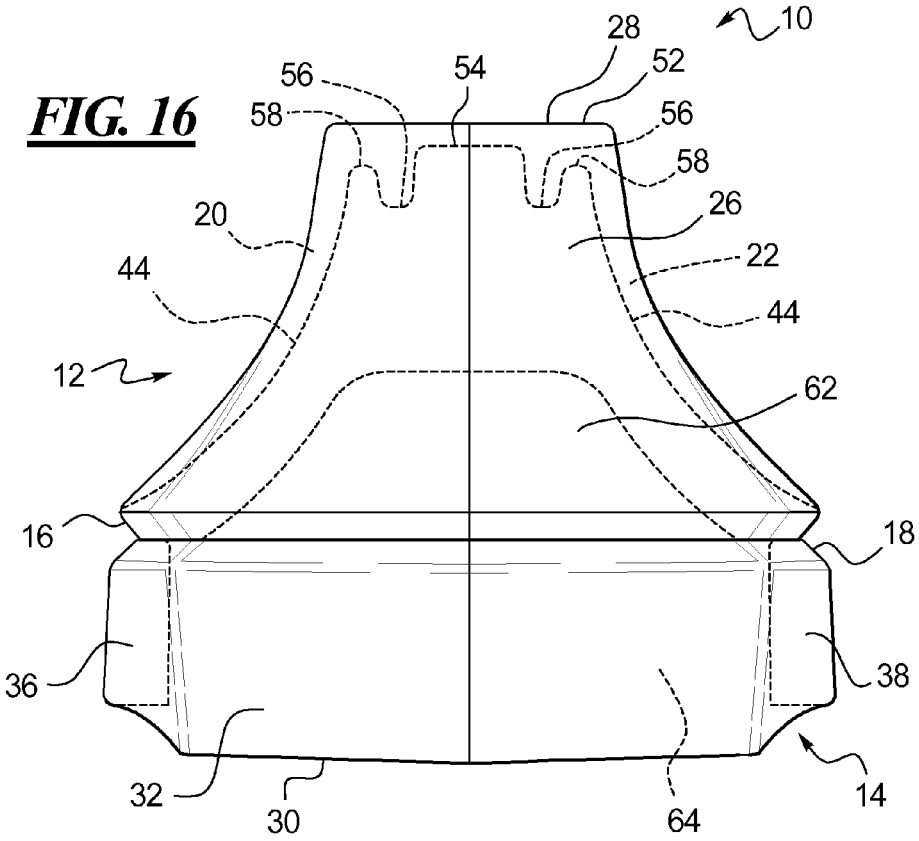
FIG. 16 is a front view of the compactor wheel tip assembly of FIG. 14.
Figure 17:
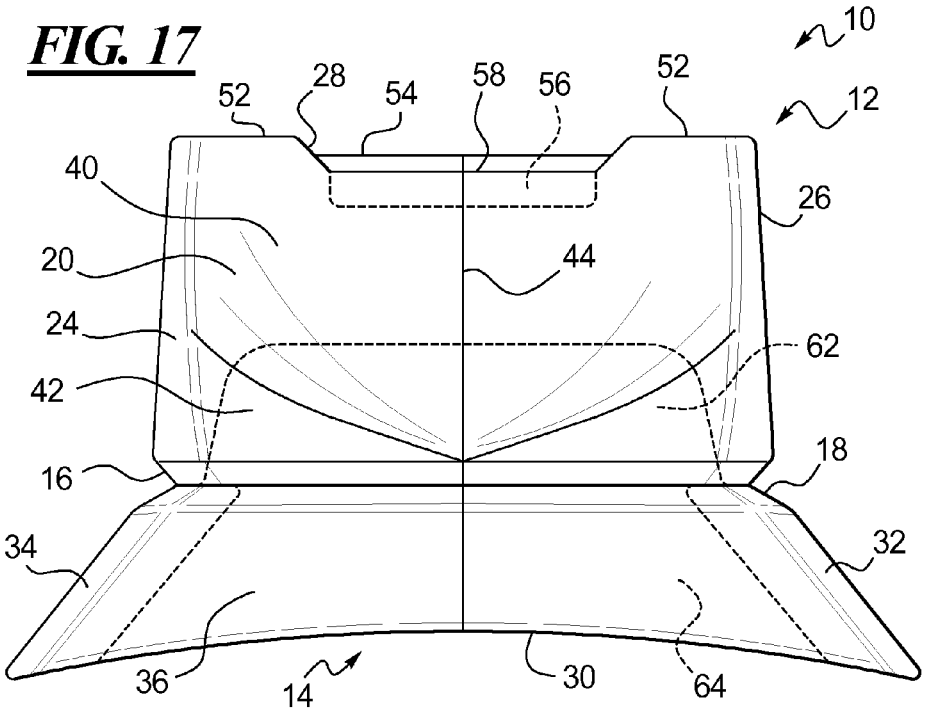
FIG. 17 is a side view of the compactor wheel tip assembly of FIG. 14.

To reduce cost and weight of the compactor wheel tip assembly 10 without compromising the useful life of the tip assembly 10, excess metal may be removed from the tip assembly 10 by providing an interior pocket formed within the tip assembly 10 by interior surfaces of the tip 12 and base 14 extending upwardly from the bottom walls 16, 30, respectively, and into the body of the tip assembly 10. The perspective views of FIGS. 2 and 9 illustrate the tip 12 having an interior surface defining a tip interior pocket 62 having a shape generally corresponding to the shape of the exterior surface of the tip 12. FIGS. 2, 10 and 11 further illustrate the base 14 having an interior surface defining a base opening 64 extending from the bottom wall 30 to and through the base top wall 18. As shown in hidden lines in FIGS. 3 and 5, and in solid lines in the cross-sectional views of FIGS. 6 and 7, the interior pocket 62 and base opening 64 may combine to define the same general shape as the exterior surface of the tip assembly 10. The similarity in shape may include having interior pocket angles and draft angles corresponding to the pocket angles $\Phi_W$ and draft angles $\Delta_F$ and $\Delta_S$. However, the interior pocket 62 and base opening 64 may be tapered slightly more severely than the exterior walls 20-26, 32-38 so that the walls are thicker and provide more wear material proximate the top of the interior pocket 62. Consequently, the side wall portions of the interior pocket 62 and the base opening 64 may have an interior pocket draft angle $\Delta_I$ with respect to a vertical line as shown in FIG. 7 that may be greater that the outer vertical draft angle $\Delta_O$ of the side walls 24/36, 26/38. To provide the necessary wall thickness, the interior draft angle $\Delta_I$ may be approximately 5°, with the steeper outer draft angle $\Delta_O$ being approximately 3°. The height of the interior pocket 62 may be established to provide a visible indication that the compactor wheel tip assembly 10 has reached or exceeded its useful life when one of more of the walls 20-26 are worn through to expose the interior pocket 62 to the external environment.

The interior pocket 62 and the base opening 64 may be substantially aligned with one another when the tip 12 is attached to the base 14 to form a continuous pocket within the compactor tip assembly 10. The intersection boundaries of the interior surfaces of the tip 12 and the base 14 may be substantially the same size and shape so that the surfaces smoothly flow into one another to form substantially continuous surfaces. With this arrangement, an optional inner V-groove may be provide so an additional inner V-groove weld may be formed within the pocket between the tip 12 and the base 14 at the intersection of the interior surfaces.

FIGS. 8-13 provide various views of the tip 12 and base 14 presented individually. FIGS. 9, 10, 12 and 13 in particular more clearly illustrate the complimentary shapes of a base engaging surface 66 of the tip 12 and a tip engaging surface 68 of the base 14. Referring to the bottom view of the tip 12 in FIG. 12, the outer edges of the base engaging surface 66 may have draft angles approximately equal to the draft angles $\Delta_F$ and $\Delta_S$ of the corresponding pocket walls 20, 22 and side walls 24, 26, respectively, on the exterior of the tip 12. The inner edges of the base engaging surface 66 at the side walls 24, 26 may similarly follow the draft angle $\Delta_S$ of the side walls 24, 26 as the interior pocket 62 of the tip 12 generally tracks the shape of the side walls 24, 26. In contrast, the inner edges of the base engaging surface 66 at the pocket walls 20, 22 allow for the pocket angle $\Phi_W$ of the concave portions 40 of the pocket walls 20, 22. As a result, those inner edges at the pocket walls 20, 22 may be straighter than the edges at the side walls 24, 26, and may even follow the pocket angle $\Phi_W$ of the concave portions 40. As shown in the top view of the base 14 in FIG. 13, the tip engaging surface 68 may similarly be shaped to conform to the draft angles of the walls 32-38, and to the pocket angles of the pocket walls 20, 22 of the tip 12 such that the tip engaging surface 68 substantially mirrors the base engaging surface 66. With this configuration, the tip 12 and the base 14 have surface-to-surface engagement around the entire perimeter of the interface between the interior pocket 62 and base opening 64 when the surfaces 66, 68 are facing and the tip 12 and base 14 are oriented and aligned as shown in FIGS. 1-7. Once aligned, the tip 12 and base 14 are ready to be welded along the V-groove.

The configuration of the engaging surfaces 66, 68 as illustrated and described may facilitate attachment of the tip 12 to the base 14 in the forward and rearward traction orientation shown in FIGS. 1-7. The engaging surfaces 66, 68 may also allow for attachment of the tip 12 to the base 14 in an alternate orientation wherein the compactor tip assembly 10 may provide greater lateral or side-slope support for the compactor machine when traveling along the side of a hill or garbage pile. FIGS. 14-17 illustrate one example of the compactor tip assembly 10 with the tip 12 rotated approximately 90° with respect to the base 14 and attached thereto. After the rotation, a tip first vertical plane 46 bisecting the tip from pocket to pocket may be approximately coincident with a base second vertical plane 48 bisecting the base from side to side, and a tip second vertical plane 48 bisecting the tip from side to side may be approximately coincident with a base first vertical plane 46 bisecting the base from front to rear. In embodiments where the draft angles $\Delta_F$ and $\Delta_S$ are approximately equal, and where the depth of the tip 12 at the tip bottom wall 16 is approximately equal to the width of the tip 12, the outer edges of the engaging surfaces 66, 68 will align when the tip 12 is rotated to the illustrated position. Consequently, as with the forward and rearward traction position, the tip 12 and the base 14 have surface-to-surface engagement around the entire perimeter of the interface between the interior pocket 62 and base opening 64 and a V-groove weld can be made within the V-groove. As will be apparent from FIGS. 16 and 17, the pocket walls 20, 22 will present a greater surface area in the compactor wheel's axial direction, and provide correspondingly greater resistance to lateral slippage of the compactor machine when traveling over a laterally pitched surface.

Figure 18:
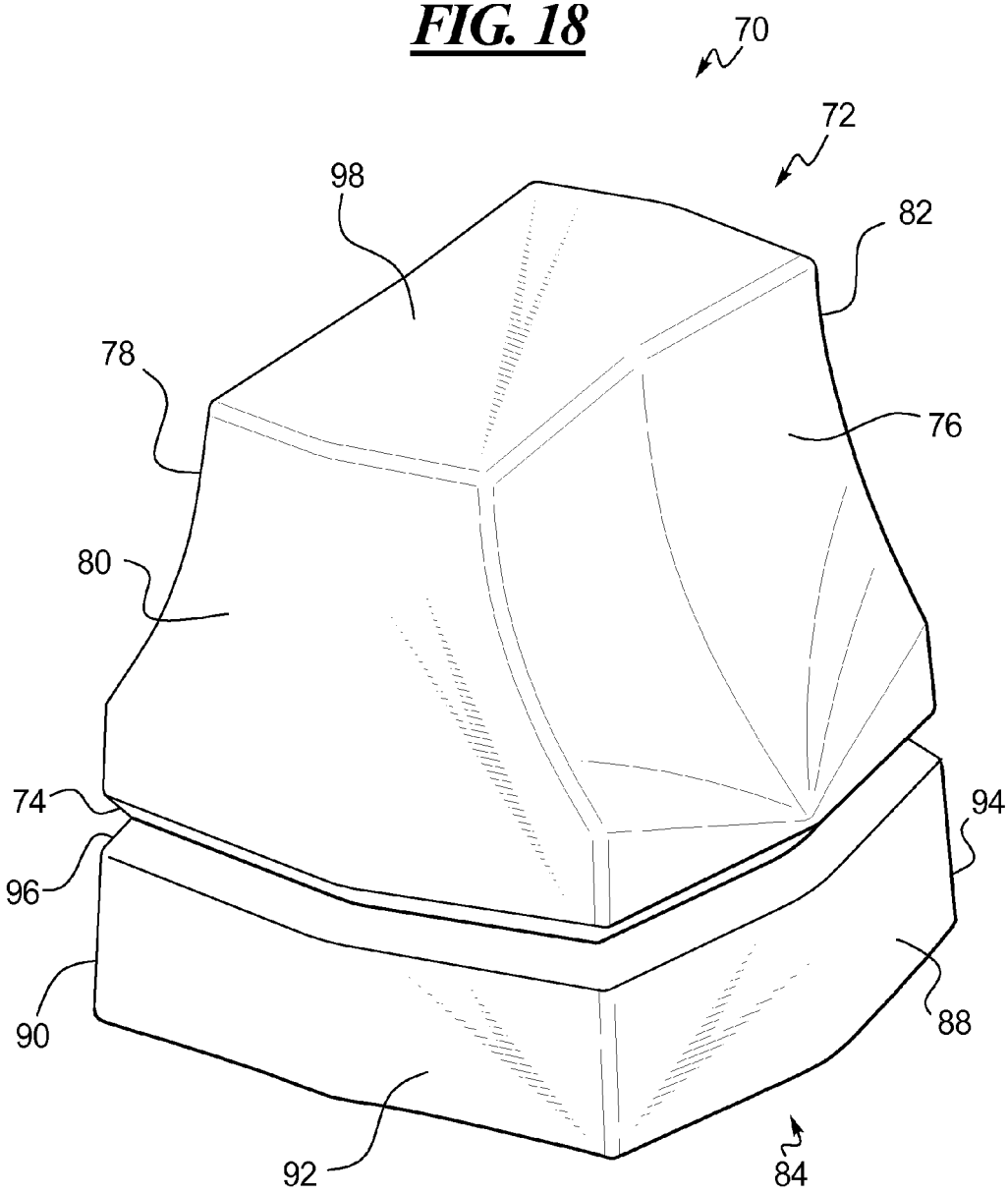
FIG. 18 is a pictorial view of an alternative embodiment of a landfill compactor wheel tip assembly in accordance with the present disclosure and having a flat ground engaging surface.

FIG. 18 illustrates an alternative embodiment of a compactor wheel tip assembly 70 have a generally planar ground engaging surface. The compactor wheel tip assembly 70 may include a tip 72 having a bottom wall 74, pocket walls 76, 78 and side walls 80, 82, and a base 84 having a bottom wall 86, a front wall 88, a rear wall 90, side walls 92, 94 and top wall 96 that may be generally configured in accordance with the descriptions of the tip 12 and base 14, respectively, provided above. Consequently, the base bottom wall 86 may include a wheel engaging surface, the pocket walls 76, 78 may have generally concave shapes, and the side walls 80, 82, 92, 94 may have generally convex shapes to reduce the amount of packing of material on the tip assembly 70 and wheel. With this configuration, the walls 74-82, 86-94 may address the design considerations of compaction, fluffing, traction and packing in a similar manner as the walls 16-26, 32-38 as discussed above. A top wall 98 of the tip 72 may have a generally planar ground engaging surface in contrast to the contoured ground engaging surface of the top wall 28 of the tip 12. When the pocket walls 76, 78 are configured with pocket angles $\Phi_W$, and the side walls 80, 82 are convex and include draft angles $\Delta_S$, the top wall 96 may have a "bow-tie"-shaped cross-section when viewed from above. In this configuration, the distance from front to back of the top wall 96 may be greater at the side edges than at the center, thereby providing additional wear metal at the lateral edges to compensate for the greater wear rate at the lateral edges.

Figure 19:
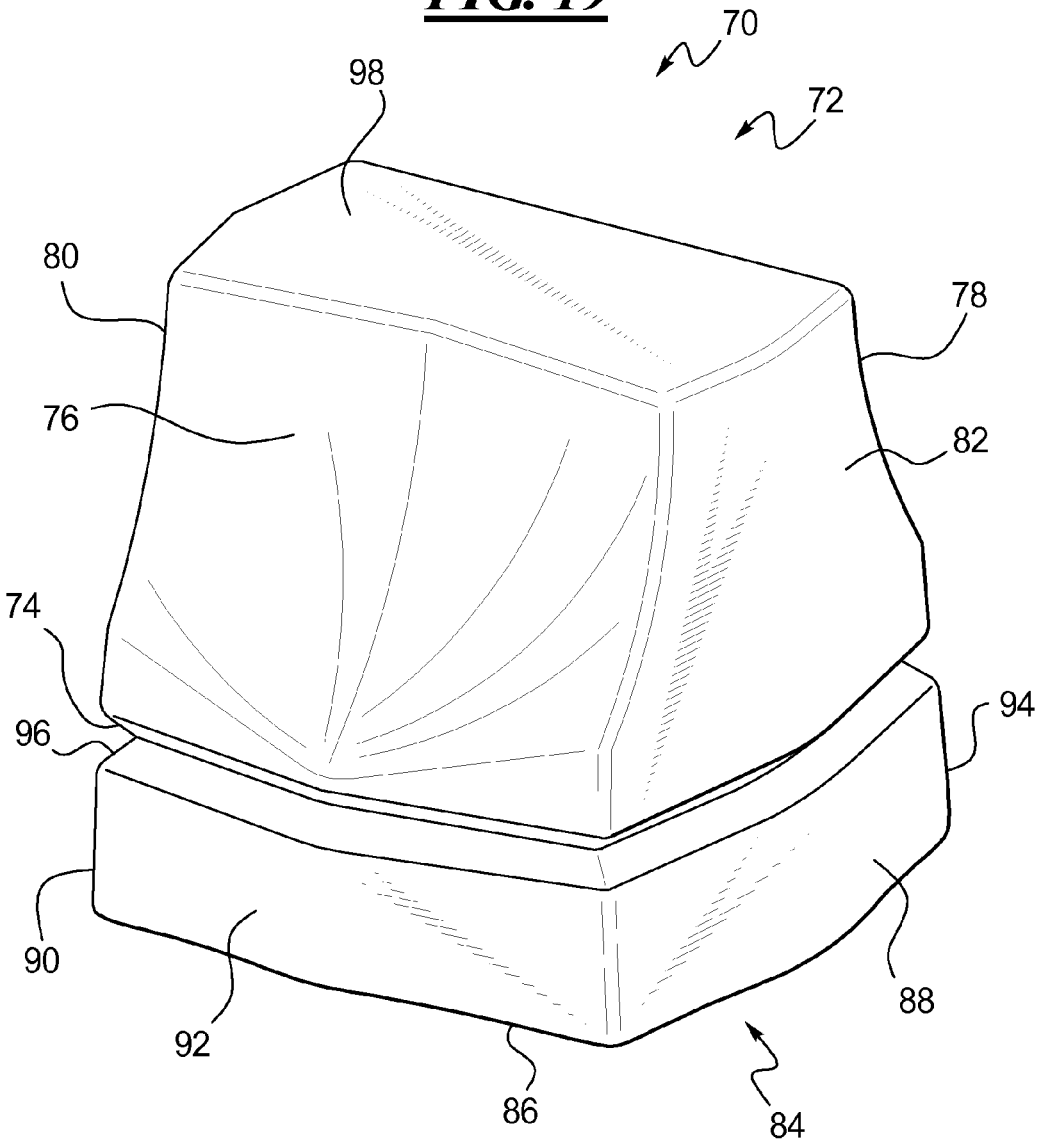
FIG. 19 is a pictorial view of the compactor wheel tip assembly of FIG. 18 with the tip rotated to a side-slope traction position.

The tip bottom wall 74 and base top wall 96 may have engaging surfaces similar to the engaging surfaces 66, 68 of the tip assembly 10 allowing the tip 72 to be attached to the base 84 in either the forward and rearward traction position shown in FIG. 18, or a side-slope traction orientation as shown in FIG. 19. The engaging surfaces may have shapes corresponding to the shapes of the tip 72 and base 84 to provide surface-to-surface engagement around the entire perimeter of the interface between an interior pocket and base opening. The pocket walls 76, 78 as shown in FIG. 18 will present a greater surface area in the compactor wheel's axial direction to provide correspondingly greater resistance to lateral slippage of the compactor machine when traveling over a laterally pitched surface.

INDUSTRIAL APPLICABILITY

Figure 20:
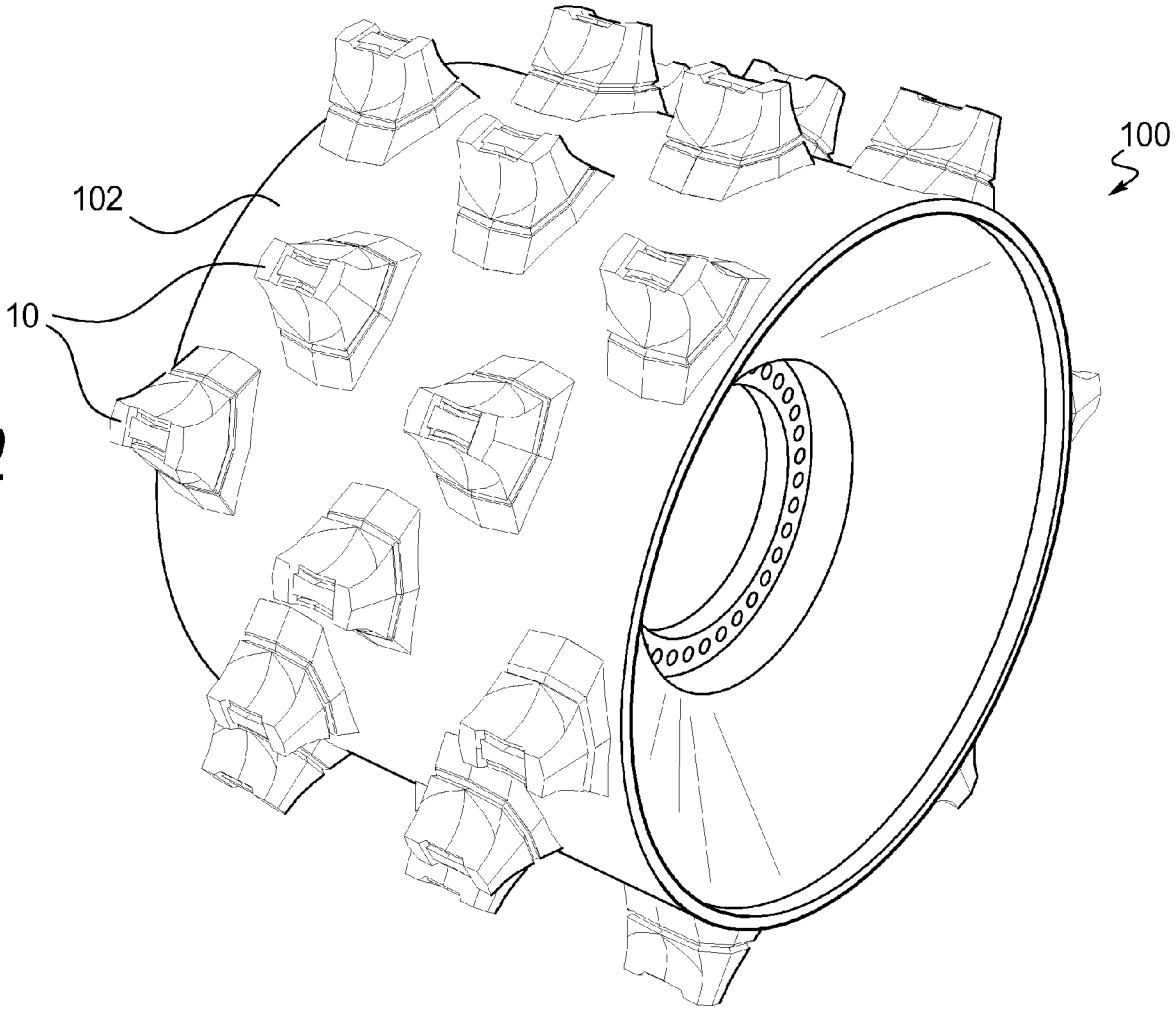
FIG. 20 is a pictorial view of a set of compactor wheel tip assemblies of FIG. 1 mounted to an exemplary landfill compactor wheel.

In general, the foregoing invention finds utility in various industrial applications, such as the construction and mining industries in providing an improved soil compacting tip for a soil compactor, and in the landfill and waste removal industries in providing an improved landfill compacting tip for landfill compactors. An exemplary landfill compactor wheel 100 having several compactor wheel tip assemblies 10 attached to the wheel wrapper 102 is illustrated in FIG. 20. The tip assemblies 10 may be arranged on the wheel wrapper 102 in a commonly known helical pattern as shown, or in any other desirable arrangement about the wheel 100 known in the art. As the compactor wheel 100 rolls over the surface, the weight of the compactor machine causes the ground engaging surfaces of the tip assemblies 10 to penetrate the surface and compact the material. The generally concave shape of the front walls of the tips 12 may cup the surface to provide traction for propelling the wheel forward. The draft angles of the bottom potions of the front walls and the generally convex surfaces of the side walls and the walls of the base may allow the tip assemblies 10 to pass through the surface with minimal material packing on the tip assemblies 10 and wheel 100. As the rotation of the wheel 100 continues, the tip assemblies 10 roll out of the material. Due to the tapering of the pocket walls from bottom to top, the tip assemblies 10 may roll out of the surface with minimal engagement by the front edges of the tip assemblies 10 with the pockets in the surface created by the tip assemblies 10 to reduce fluffing at the surface in a similar manner that tapered gear teeth avoid binding with each other as they roll into and out of engagement.

Figure 21:
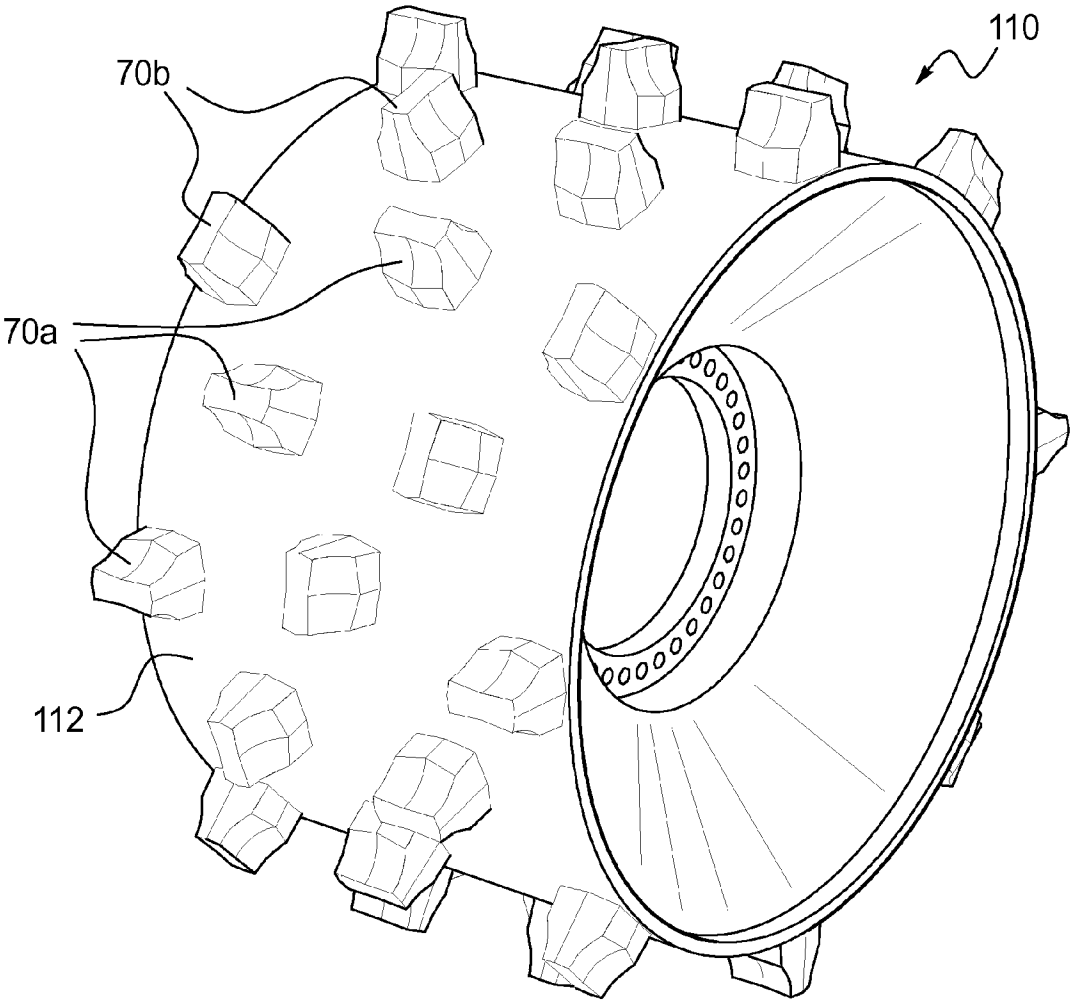
FIG. 21 is a pictorial view of a set of compactor wheel tips from FIGS. 18 and 19 mounted to an exemplary landfill compactor wheel.

Another exemplary landfill compactor wheel 110 shown in FIG. 21 includes both forward and rearward traction tip assemblies **70*a* and side-slope traction tip assemblies 70*b* attached to the wheel wrapper 112. The tip assemblies 70*a* perform in a similar manner as described above for the wheel 100. The side-slope traction tip assemblies 70*b* provide additional lateral traction as the compactor machine travels over a laterally pitched surface. The additional side surface area of the combined tip assemblies 70*a*, 70*b* lessens the amount of slippage down the side slope of the hill experienced by compactor machine, thereby further stabilizing the machine during travel. As with the configuration of the tip assemblies 10 on the wheel 100, the tip assemblies 70*a*, 70*b* may be arranged about the wheel wrapper 112** in any desired configuration to achieve the desired balance of compaction and traction during operation of the compactor machine.

Figure 22:
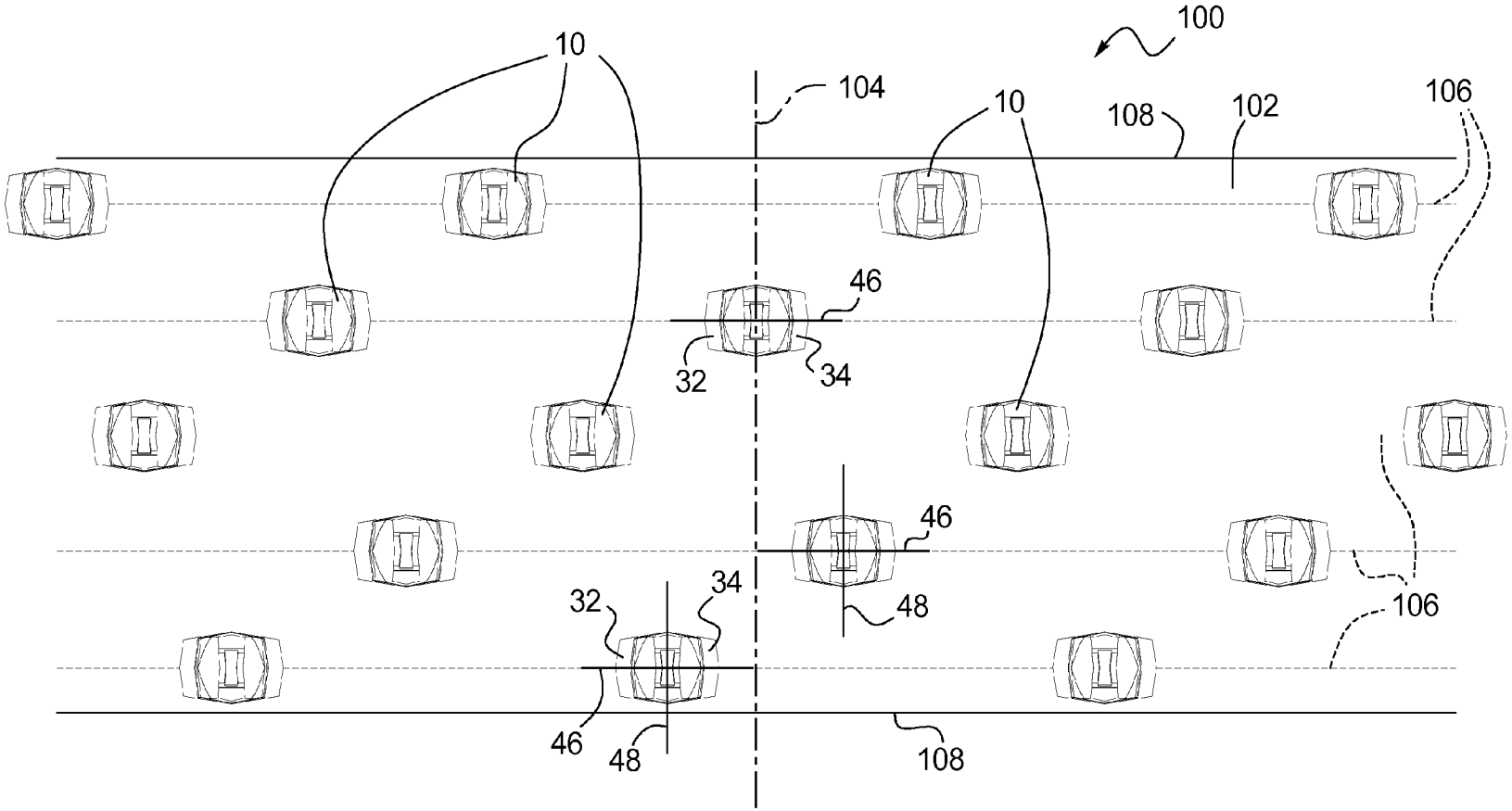
FIG. 22 is top view of the compactor wheel of FIG. 20 with the wheel wrapper flattened out and the compactor wheel tip assemblies oriented in a first position.

On the compactor wheels 100, 110 of FIGS. 20 and 21, the wheel engaging surfaces of the bottom walls 30 of the bases 14 may be contoured so that the front and rear walls 32, 34 are generally perpendicular to the direction of travel of the compactor wheels 100, 110. As further illustrated in FIG. 22, in which the wheel wrapper 102 may be flattened to show the arrangement of the tip assemblies 10 on the wheel 100. The rotational axis of the wheel 100 is illustrated graphically by a line 104, and the tip assemblies 10 may be positioned on the wheel wrapper 102 along a plurality of circumferential lines 106 of the wheel 100 spaced across the wheel wrapper 102 between lateral edges 108 of the wheel 100. The wheel engaging surfaces of the bases 14 may be shaped so that the first vertical planes 46 of the tip assemblies 10 may be approximately parallel to the circumferential lines 106 and the second vertical planes 48 are approximately parallel to the rotational axis 104 of the wheel 100 when the tip assemblies 10 are attached to the wheel wrapper 102. Consequently, the side portions of the wheel engaging surfaces may have a curvature from front to rear approximating the curvature of the wheel wrapper 102, while the edges of the surface proximate the base front and rear walls 32, 34 may be approximately linear. The wheel 110 may have a similar appearance with the wheel wrapper 112 laid flat, but with some of the tip assemblies 10 having tips 12 rotated 90° with respect to the base as discussed above for the tip assemblies 70 to provide additional side-slope traction.

Figure 23:
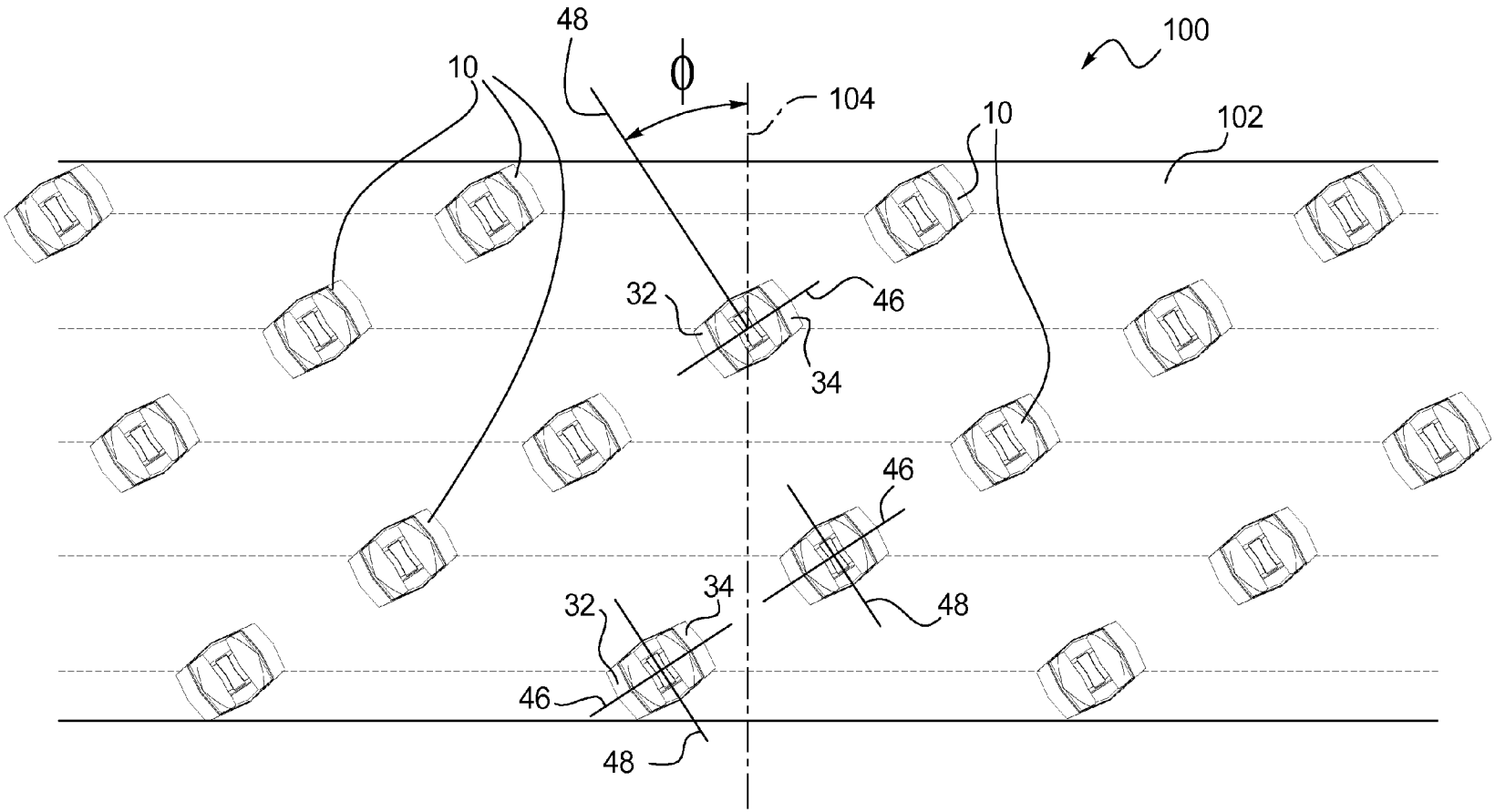
FIG. 23 is a top view of the compactor wheel of FIG. 20 with the wheel wrapper flattened out and the compactor wheel tip assemblies oriented in an offset position with respect to the wheel's rotational axis.

In some implementations, it may be desirable to purposely direct material toward one of the lateral edges 108 of the wheel 100, or to provide additional side-slope traction by means other than or in addition to the side-slope traction configuration of the tip assemblies 70 shown in FIG. 19. To that end, it may be desired to reconfigure the wheel engaging surface of the base bottom walls 30, 86 to orient the tip assemblies 10, 70 at angles with respect to the rotational axis 104 of the wheel 100. Referring to FIG. 23, the wheel engaging surfaces may be contoured so that the second vertical planes 48 of the tip assemblies 10 are rotated with respect to the rotational axis 104 by an offset angle Θ when the tip assemblies 10 are attached to the wheel wrapper 102. In the illustrated embodiment, wheel engaging surfaces may have a curvature from one corner of the front wall 32 to the opposite corner of the rear wall 34 matching the curvature of the wheel wrapper 102.

Depending on the desired amount of rotation of the tip assemblies 10, the wheel engaging surface may be contoured to provide an offset angle Θ of as much as approximately 45°, or may be within a range from 5° to 45°, such as the ranges from 10° to 40°, 15° to 35°, and 20° to 30°, or may have a value of approximately 25°. In some implementations, it may be desired have the offset angle Θ be approximately equal to the pocket angle $\Phi_W$ of the concave portions 40 of the pocket walls 20, 22. In such cases, the offset angle Θ may have a value up to approximately 10°, and may be within the range from 2.5° to 5.5°, such as angles of approximately 3° or approximately 5°, depending on the value of the pocket angle $\Phi_W$. Where the tip assemblies 10 are rotated by an offset angle Θ, the edges of the surface proximate the base front and rear walls 32, 34 may have a curvature approximating the curvature of the wheel wrapper 102 in a similar manner as the side portions of the wheel engaging surfaces. With the tip assemblies 10 rotated toward the offset angle Θ, surface material may be directed toward one of the sides of the wheel 100 by the slopes provided by the angled pocket walls 20, 22, and an additional amount of side-slope traction may result from the increased surface area of the tip assemblies 10 presented in the direction of the rotational axis of the wheel 100 than with the tip assembly 10 orientation shown in FIG. 22.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fail within the scope of the claims defining the invention.

What is claimed is:

1. A compactor wheel tip assembly, comprising:

a tip, comprising:

a tip bottom wall having a base engaging surface, a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, and with portions of the pocket walls proximate the tip bottom wall having a convex shape so that a distance between the pocket walls decreases as the pocket walls extend outwardly from a first tip vertical plane bisecting the tip from pocket wall to pocket wall, and a pair of oppositely disposed tip side walls extending upwardly from the tip bottom wall to the tip top wall with portions of the tip side walls proximate the tip bottom wall having a convex shape so that a distance between the tip side walls decreases as the tip side walls extend outwardly from a second tip vertical plane bisecting the tip from side wall to side wall; and a base, comprising:

a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, with portions of the base front and rear walls proximate the base top wall having a shape that is complimentary to the convex shapes of the portions of the pocket walls and the tip side walls proximate the tip bottom wall so that the pocket walls and the base front and rear walls form substantially continuous surfaces when the tip is oriented in a first orientation with the pocket walls aligned with the base front and rear walls, and so that the tip side walls and the base front and rear walls form substantially continuous surfaces when the tip is oriented in a second orientation with the tip side walls aligned with the base front and rear walls, and a pair of oppositely disposed base side walls extending upwardly from the base bottom wall to the base top wall, with portions of the base side walls proximate the base top wall having a convex shape that is complimentary to the convex shapes of the portions of the pocket walls and the tip side walls proximate the tip bottom wall so that the pocket walls and the base side walls form substantially continuous surfaces when the tip is oriented with in the second orientation, and so that the tip side walls and the base side walls form substantially continuous surfaces when the tip is oriented in the first orientation, wherein the base engaging surface and the tip engaging surface have corresponding geometries so that the tip is attachable to the base with the tip and base engaging surfaces facing and abutting when the tip is aligned in the first orientation and when the tip is aligned in the the second orientation, and wherein the tip is attached to the base with the tip and base engaging surfaces facing and abutting with the tip aligned in one of the first orientation and the second orientation.

2. A compactor wheel tip assembly according to claim 1, wherein the distance between the tip side walls proximate the tip top wall is greater than the distance between the pocket walls proximate the tip top wall.

3. A compactor wheel tip assembly according to claim 1, wherein the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is parallel to a rotational axis of the compactor wheel to which the compactor wheel tip assembly will be attached.

4. A compactor wheel tip assembly according to claim 1, wherein the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is not parallel to a rotational axis of the compactor wheel to which the compactor wheel tip assembly will be attached, with the vertical plane being offset from the rotational axis by an offset angle Θ.

5. A compactor wheel tip assembly according to claim 4, wherein the offset angle Θ is approximately 45°.

6. A compactor wheel tip assembly according to claim 4, wherein the offset angle Θ is in the range of 5° to 45°.

7. A compactor wheel tip assembly according to claim 1, wherein the base comprises a base interior surface defining a base opening through the base and extending from the base bottom wall through the base top wall, and wherein the tip comprises a tip interior surface defining an interior pocket of the tip extending upwardly from the tip bottom wall into the interior of the tip, wherein the base opening and the interior pocket align to form generally continuous interior walls within the compactor wheel tip assembly when the pocket walls are aligned with the front and rear walls of the base.

8. A compactor wheel tip assembly, comprising:

a tip, comprising:

a tip bottom wall having a base engaging surface, a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, wherein portions of the pocket walls proximate the tip bottom wall extend outwardly from a first tip vertical plane bisecting the tip from pocket wall to pocket wall at a horizontal draft angle Δ with respect to a line perpendicular to the first tip vertical plane such that the distance between portions of the pocket walls decreases as the pocket walls extend outwardly from the first tip vertical plane toward the tip side walls, and a pair of oppositely disposed tip side walls extending upwardly from the tip bottom wall to the tip top wall, wherein portions of the tip side walls proximate the tip bottom wall extend outwardly from a second tip vertical plane bisecting the tip from side to side at the horizontal draft angle Δ with respect to a line perpendicular to the second tip vertical plane such that the distance between the portions of the tip side walls decreases as the tip side walls extend outwardly from the second tip vertical plane toward the pocket walls; and a base, comprising:

a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, wherein portions of the front and rear walls proximate the base top wall extend outwardly from a first base vertical plane bisecting the base from front to rear at the horizontal draft angle Δ with respect to a line perpendicular to the first base vertical plane such that the distance between the portions of the front and rear walls decreases as the front and rear walls extend outwardly from the first base vertical plane toward the base side walls, and a pair of oppositely disposed base side walls extending upwardly from the base bottom wall to the base top wall, wherein portions of the base side walls proximate the base top wall extend outwardly from a second base vertical plane bisecting the base from side to side at the horizontal draft angle Δ with respect to a line perpendicular to the second base vertical plane such that the distance between the portions of the base side walls decreases as the base side walls extend outwardly from the second base vertical plane toward the front and rear walls, wherein the base engaging surface and the tip engaging surface have corresponding geometries so that the tip is attachable to the base with the tip and base engaging surfaces facing and abutting when the tip is aligned in a first orientation with the pocket walls aligned with the base front and rear walls and when the tip is aligned in a second orientation with the pocket walls aligned with the base side walls, and wherein the tip is attached to the base with the tip and base engaging surfaces facing and abutting with the tip aligned in one of the first orientation and the second orientation.

9. A compactor wheel tip assembly according to claim 8, wherein the horizontal draft angle Δ is approximately 10°.

10. A compactor wheel tip assembly according to claim 8, wherein the pocket walls each have a curved portion having a curvature causing the distance between the pocket walls to decrease as the curved portions extend upwardly away from the tip bottom wall and toward the tip top wall, and wherein the curved portions of each of the pocket walls extend outwardly from the first tip vertical plane at a pocket angle Φ with respect to a line perpendicular to the first tip vertical plane such that the distance between the curved portions increases as the pocket walls extend outwardly from the first tip vertical plane toward the tip side walls.

11. A compactor wheel tip assembly according to claim 10, wherein the pocket angle Φ has a value in the range of 2.5° to 5.5°.

12. A compactor wheel tip assembly, comprising:

a tip, comprising:

a tip bottom wall having a base engaging surface a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, and a pair of oppositely disposed tip side walls extending upwardly from the tip bottom wall to the tip top wall; and a base, comprising:

a base bottom wall having a wheel engaging surface, wherein the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is not parallel to a rotational axis of the compactor wheel to which the compactor wheel tip assembly will be attached, with the vertical plane being offset from the rotational axis by an offset angle Θ, a base top wall having a tip engaging surface, oppositely disposed front and rear walls extending upwardly from the base bottom wall to the base top wall, with the distance between the front and rear walls being greater proximate the base bottom wall than proximate the base top wall, and a pair of oppositely disposed base side walls extending upwardly from the base bottom wall to the base top wall, wherein the base engaging surface and the tip engaging surface have corresponding geometries so that the tip is attachable to the base with the tip and base engaging surfaces facing and abutting when the tip is aligned in a first orientation with the pocket walls aligned with the base front and rear walls and when the tip is aligned in a second orientation with the pocket walls aligned with the base side walls, and wherein the tip is attached to the base with the tip and base engaging surfaces facing and abutting with the tip aligned in one of the first orientation and the second orientation, wherein the pocket walls each have a curved portion having a curvature causing the distance between the pocket walls to decrease as the curved portions extend upwardly away from the tip bottom wall and toward the tip top wall, wherein the curved portions of each of the pocket walls extend outwardly from a first tip vertical plane bisecting the tip from pocket wall to pocket wall at a pocket angle Φ with respect to a line perpendicular to the first tip vertical plane such that the distance between the curved portions increases as the pocket walls extend outwardly from the first tip vertical plane toward the tip side walls, and wherein the offset angle Θ is approximately equal to the pocket angle Φ.

13. A compactor wheel tip assembly, comprising:

a tip, comprising:

a tip bottom wall having a base engaging surface, a tip top wall having a ground engaging surface, oppositely disposed pocket walls extending upwardly from the tip bottom wall to the tip top wall, the pocket walls having a concave shape, with the distance between the pocket walls being greater proximate the tip bottom wall than proximate the tip top wall, and with portions of the pocket walls proximate the tip bottom wall having a convex shape so that a distance between the pocket walls decreases as the pocket walls extend outwardly from a first tip vertical plane bisecting the tip from pocket wall to pocket wall, and a pair of oppositely disposed tip side walls extending upwardly from the tip bottom wall to the tip top wall with portions of the tip side walls proximate the tip bottom wall having a convex shape so that a distance between the tip side walls decreases as the tip side walls extend outwardly from a second tip vertical plane bisecting the tip from side wall to side wall; and a base, comprising:

a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, with portions of the base front and rear walls proximate the base top wall having a shape that is complimentary to the convex shapes of the portions of the pocket walls and the tip side walls proximate the tip bottom wall so that the pocket walls and the base front and rear walls form substantially continuous surfaces when the tip is oriented in a first orientation with the pocket walls aligned with the base front and rear walls, and so that the tip side walls and the base front and rear walls form substantially continuous surfaces when the tip is oriented in a second orientation with the tip side walls aligned with the base front and rear walls, and a pair of oppositely disposed base side walls extending upwardly from the base bottom wall to the base top wall, with portions of the base side walls proximate the base top wall having a convex shape that is complimentary to the convex shapes of the portions of the pocket walls and the tip side walls proximate the tip bottom wall so that the pocket walls and the base side walls form substantially continuous surfaces when the tip is oriented with in the second orientation, and so that the tip side walls and the base side walls form substantially continuous surfaces when the tip is oriented in the first orientation, wherein the base engaging surface and the tip engaging surface have corresponding geometries with the tip being attachable to the base with the tip and base engaging surfaces facing and abutting.

14. A compactor wheel tip assembly according to claim 13, wherein the tip is welded to the base.

15. A compactor wheel tip assembly according to claim 13, wherein the base engaging surface and the tip engaging surface have corresponding geometries so that the tip is attachable to the base when the tip is aligned in the first orientation and when the tip is aligned in the second orientation.

16. A compactor wheel tip assembly according to claim 13, wherein the tip is attached to the base with the pocket walls aligned with the base side walls.

17. A compactor wheel tip assembly according to claim 13, wherein the pocket walls each have a curved portion having a curvature causing the distance between the pocket walls to decrease as the curved portions extend upwardly away from the tip bottom wall and toward the tip top wall, and wherein the curved portions of each of the pocket walls extend outwardly from a first tip vertical plane at a pocket angle Φ with respect to a line perpendicular to the first tip vertical plane such that the distance between the curved portions increases as the pocket walls extend outwardly from the first tip vertical plane toward the tip side walls.

18. A compactor wheel tip assembly according to claim 13, wherein the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is parallel to a rotational axis of the compactor wheel to which the compactor wheel tip assembly will be attached.

19. A compactor wheel tip assembly according to claim 13, wherein the wheel engaging surface has a curvature corresponding to an outer circumference of a compactor wheel to which the compactor wheel tip assembly will be attached, and wherein the curvature of the wheel engaging surface is such that a vertical plane bisecting the base from side to side is not parallel to a rotational axis of the compactor wheel to which the compactor wheel tip assembly will be attached, with the vertical plane being offset from the rotational axis by an offset angle Θ.

20. A compactor wheel tip assembly, comprising:

a tip, comprising:

a tip bottom wall having a base engaging surface, a tip top wall having a ground engaging surface, pocket walls extending upwardly from the tip bottom wall to the tip top wall, the pocket walls having a concave shape, with the distance between the pocket walls being greater proximate the tip bottom wall than proximate the tip top wall, wherein portions of the pocket walls proximate the tip bottom wall extend outwardly from a first tip vertical plane bisecting the tip from pocket wall to pocket wall at a horizontal draft angle Δ with respect to a line perpendicular to the first tip vertical plane such that the distance between portions of the pocket walls decreases as the pocket walls extend outwardly from the first tip vertical plane toward the tip side walls, and a pair of oppositely disposed tip side walls extending upwardly from the tip bottom wall to the tip top wall, wherein portions of the tip side walls proximate the tip bottom wall extend outwardly from a second tip vertical plane bisecting the tip from side to side at the horizontal draft angle Δ with respect to a line perpendicular to the second tip vertical plane such that the distance between the portions of the tip side walls decreases as the tip side walls extend outwardly from the second tip vertical plane toward the pocket walls; and a base, comprising:

a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, wherein portions of the front and rear walls proximate the base top wall extend outwardly from a first base vertical plane bisecting the base from front to rear at the horizontal draft angle Δ with respect to a line perpendicular to the first base vertical plane such that the distance between the portions of the front and rear walls decreases as the front and rear walls extend outwardly from the first base vertical plane toward the base side walls, and a pair of oppositely disposed base side walls extending upwardly from the base bottom wall to the base top wall, wherein portions of the base side walls proximate the base top wall extend outwardly from a second base vertical plane bisecting the base from side to side at the horizontal draft angle Δ with respect to a line perpendicular to the second base vertical plane such that the distance between the portions of the base side walls decreases as the base side walls extend outwardly from the second base vertical plane toward the front and rear walls, wherein the base engaging surface and the tip engaging surface have corresponding geometries with the tip being attachable to the base with the tip and base engaging surfaces facing and abutting.

21. A compactor wheel tip assembly, comprising:

a tip, comprising:

a tip bottom wall having a base engaging surface, a tip top wall having a ground engaging surface, wherein the ground engaging surface defines a pair of shoulders each extending inwardly from a corresponding one of the tip side walls, a rib extending between the shoulders, and a pair of external pockets disposed on opposite sides of the rib and extending between the shoulders, wherein the external pockets extend downwardly between the rib and corresponding portions of the pocket walls, pocket walls extending upwardly from the tip bottom wall to the tip top wall, the pocket walls having a concave shape, with the distance between the pocket walls being greater proximate the tip bottom wall than proximate the tip top wall, and a pair of oppositely disposed tip side walls extending upwardly from the tip bottom wall to the tip top wall; and a base, comprising:

a base bottom wall having a wheel engaging surface, a base top wall having a tip engaging surface, oppositely disposed front and rear walls extending upwardly from the base bottom wall to the base top wall, with the distance between the front and rear walls being greater proximate the base bottom wall than proximate the base top wall, and a pair of oppositely disposed base side walls extending upwardly from the base bottom wall to the base top wall, wherein the base engaging surface and the tip engaging surface have corresponding geometries with the tip being attachable to the base with the tip and base engaging surfaces facing and abutting.

* * * * *